US006138901A

United States Patent [19]

Kim et al.

[11] Patent Number: 6,138,901

[45] Date of Patent: Oct. 31, 2000

[54] MULTIPURPOSE ADJUSTABLE SINGLE SHEET CONTAINER

[76] Inventors: Bobby Kim; Susie Y. Kim, both of 12331 E. Arkansas Ave., Aurora, Colo. 80112; Richard H. Kim; Debra Y. Kim, both of 10075 E. Warren Ave., Denver, Colo. 80231

[21] Appl. No.: 09/190,626

[22] Filed: Nov. 12, 1998

Related U.S. Application Data

[60] Provisional application No. 60/065,824, Nov. 14, 1997, provisional application No. 60/070,441, Jan. 5, 1998, and provisional application No. 60/085,583, May 15, 1998.

[51] Int. Cl.[7] ..... B65D 5/00

[52] U.S. Cl. ..... 229/101; 229/132; 229/138

[58] Field of Search ..... 229/101, 103, 229/138, 132; 383/121, 125, 126, 120

[56] References Cited

U.S. PATENT DOCUMENTS

| | | | |
|---|---|---|---|
| 1,125,535 | 1/1915 | Hoffman | 229/101 |
| 2,382,891 | 8/1945 | McCormick | 229/930 X |
| 2,925,948 | 2/1960 | Alden . | |
| 3,032,253 | 5/1962 | Younger . | |
| 3,120,335 | 2/1964 | Egleston et al. . | |
| 3,313,467 | 4/1967 | Anderskow et al. | 229/101 X |
| 3,559,871 | 2/1971 | Vaughn | 229/109 |
| 3,589,303 | 6/1971 | Folz | 229/101 |
| 3,672,558 | 6/1972 | Johnson . | |
| 3,695,508 | 10/1972 | Hocking . | |
| 3,727,827 | 4/1973 | Stice . | |
| 4,136,817 | 1/1979 | Perry . | |
| 4,511,079 | 4/1985 | Lopez . | |
| 4,511,080 | 4/1985 | Madsen, et al. . | |

FOREIGN PATENT DOCUMENTS

| | | | |
|---|---|---|---|
| 97022 | 12/1983 | European Pat. Off. . | |
| 03711751 | 4/1932 | United Kingdom | 229/101 |
| 1029562 | 5/1966 | United Kingdom . | |

*Primary Examiner*—Stephen P. Garbe
*Assistant Examiner*—Tri M. Mai
*Attorney, Agent, or Firm*—Dorsey & Whitney LLP

[57] ABSTRACT

A blank sheet of foldable material has vertical fold lines and horizontal fold lines defined thereon and a tab for forming the blank into a closed shape. By creasing or folding the container along the pre-formed horizontal and vertical fold lines, containers of various shapes may be formed.

6 Claims, 21 Drawing Sheets

MULTIPURPOSE ADJUSTABLE SINGLE SHEET CONTAINER

CROSS-REFERENCE TO RELATED APPLICATIONS

This application is related to and claims priority to our co-pending provisional patent applications Ser. Nos. 60/065,824, filed Nov. 14, 1997, for Multipurpose Adjustable Single Sheet Container; 60/070,441, filed Jan. 5, 1998, for Multipurpose Adjustable Single Sheet Container; and 60/085,583, filed May 15, 1998, for Multipurpose Adjustable Single Sheet Container. Each of these three applications is hereby incorporated by reference as though fully disclosed herein.

BACKGROUND OF THE INVENTION

The present invention relates generally to shipping containers and, more particularly, to multipurpose containers that may be folded into various configurations to accommodate different size items. Typically, shipping and storage containers come in limited sizes and shapes with integration of multiple pieces often required. This results in larger-than-necessary containers being utilized with the excess interior space being absorbed by filler material.

It is desirable, therefore, to have an adjustable shipping container that is capable of accommodating a variety of different sized items without having to add additional pieces.

SUMMARY OF THE INVENTION

It has been discovered that a single flat form or blank can be designed so as to allow that blank to be manipulated into one of several shaped shipping or storage containers that are secured with the help of strategically spaced self-adhesive tape strips or glue without requiring extrinsic materials. This allows the packaging of items utilizing a minimum of exterior dimension resulting in a reduced requirement for filler materials in packing an item, and a reduced space requirement for the storage and shipment of an item.

Accordingly, it is an object of the disclosed invention to provide an improved blank that may be manipulated into one of several shipping or storage containers.

The present invention comprises a blank from which multiple containers may be formed. The blank includes a substantially rectangular sheet of foldable and creasable material having a plurality of horizontal fold lines and a plurality of vertical fold lines. The sheet further includes a top edge, a bottom edge, and a tab along the top edge. The tab may be secured along the bottom edge to form a preliminary of precursor configuration from which containers of various shapes are formed by selectively folding the sheet along the horizontal and vertical fold lines.

The invention also comprises a method of forming containers from a blank that includes a substantially rectangular sheet of foldable and creasable material. The sheet includes a plurality of horizontal fold lines, a plurality of vertical fold lines, a top edge, a bottom edge, a tab along the top edge, and a back side. The method comprises the steps of forming a precursor configuration, making at least four bends to form a container of a desired cross-sectional area, folding left and right end flaps thereby setting the length of the container, folding top and bottom end flaps onto the left and right end flaps, and affixing the top and bottom end flaps to the left and right end flaps. The precursor configuration is formed by folding the tab against the back side of the sheet, folding the sheet substantially in half, and gluing or taping the tab to the back side of the sheet adjacent the bottom edge of the sheet.

To form certain container configurations, portions of the blank are then removed to facilitate folding. In particular, the substantially rectangular sheet may also comprise at least two extended portions, and these extended portions are removed to facilitate folding of the blank into certain container shapes.

A more detailed explanation of the invention is provided in the following description and claims, and is illustrated in the accompanying drawings.

DESCRIPTION OF THE PREFERRED EMBODIMENTS

Figure 1:
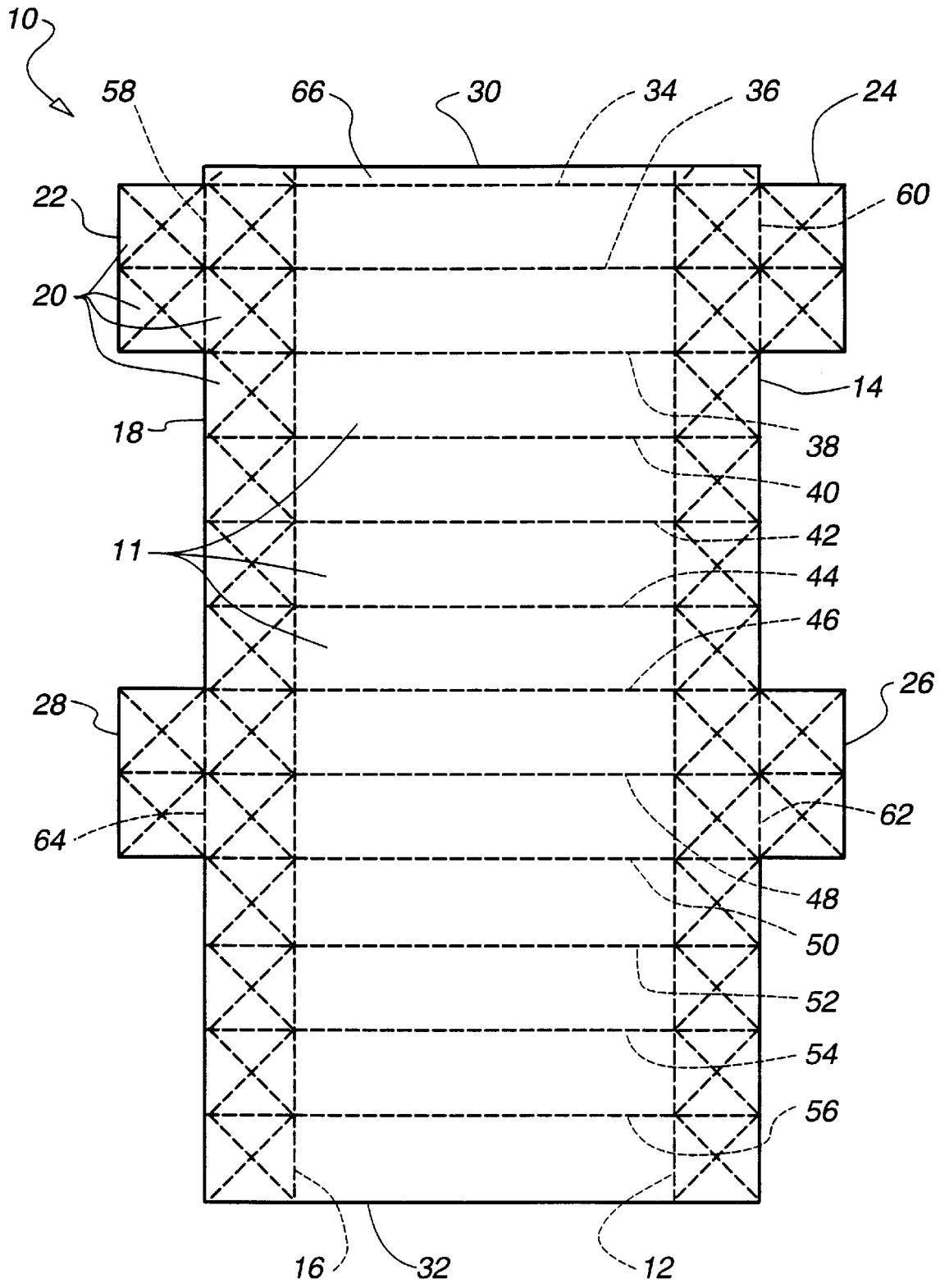
FIG. 1 is an overall planform view of a first embodiment of a blank used to make various containers.

The present invention essentially comprises a blank (10 in FIGS. 1 and 10' in FIG. 13) manufactured from a substantially rectangular sheet of paper, cardboard, or some other flexible material that may be folded and secured to form containers of various shapes and volumes. The blank 10, 10' comprises various pre-creased, scored, pleated, or pre-flexed bend lines to facilitate shaping the blank into the various configurations (see, e.g., FIGS. 4C, 5C, 6C, 7E, 8D, 9D, 10E, 11D, 12D, and 16–26). In each of the preferred embodiments, the blank 10, 10' also comprises twelve pre-formed panels (11 in FIG. 1 or 11' in FIG. 13). In the first preferred embodiment (see FIG. 1), each of the twelve pre-formed panels is substantially the same size. In the second preferred embodiment (FIG. 13), however, ten of the pre-formed panel are substantially the same size, whereas the other two are substantially the same size as each other but larger than the remaining ten panels. If desired, adhesive strips (not shown) may be strategically placed on the blank 10, 10' to facilitate attaching various portions of the blank 10, 10' to one another to form the variety of container shapes possible. For example, in the first preferred embodiment, an adhesive strip is placed on one side of the blank 10 between a second ancillary fold line 12 and a right edge 14, and an adhesive strip is similarly placed between a first ancillary fold line 16 and a left edge 18. Adhesive strips are also present on both crisscross panels 20 of the four extended portions 22, 24, 26, 28. In the preferred embodiments, the adhesive is two-sided tape.

In the first preferred embodiment, from the basic blank 10 depicted in FIG. 1, at least nine different container shapes are possible (see, e.g., FIGS. 4C, 5C, 6C, 7E, 8D, 9D, 10E, 11D, and 12D). Referring first to FIG. 1, the basic elements of the blank 10 are described. The blank 10 comprises a top edge 30, left and right side edges 18, 14, respectively, a bottom edge 32, horizontal fold lines, and vertical fold lines.

The horizontal fold lines comprise a series of twelve fold lines (34, 36, 38, 40, 42, 44, 46, 48, 50, 52, 54, and 56) located at spaced intervals between and parallel to the top edge 30 and the bottom edge 32. A first fold line 34 is adjacent and parallel to the top edge 30. A second fold line 36 is adjacent to the first fold line 34 on the side of the first fold line 34 most distant from the top edge 30. Moving toward the bottom edge 32, a third fold line 38 is next encountered, then a fourth fold line 40, a fifth fold line 42, continuing to a twelfth fold line 56. The twelfth fold line 56 is the closest fold line to the bottom edge 32. In this preferred embodiment, the distance between the adjacent fold lines remains constant. For example, the perpendicular distance between the first fold line 34 and the second fold line 36 is substantially the same as the perpendicular distance between the second fold line 36 and the third fold line 38, or the perpendicular distance between the sixth fold line 44 and the seventh fold line 46. Similarly, the perpendicular distance between the twelfth fold line 56 and the bottom edge 32 of the blank 10 is substantially equal to the perpendicular distance between adjacent fold lines.

The vertical fold lines comprise a first truncated fold line 58, a second truncated fold line 60, a third truncated fold line 62, a fourth truncated fold line 64, and two longer pre-creased or pre-folded lines. The two longer fold lines are the first ancillary fold line 16, adjacent and parallel to the left edge 18 of the blank 10, and the second ancillary fold line 12, adjacent and parallel to the right edge 14 of the blank 10 depicted in FIG. 1.

As visible in FIG. 1, the blank 10 also comprises a first extended portion 22, a second extended portion 24, a third extended portion 26, and a fourth extended portion 28. The first extended portion 22 and the fourth extended portion 28 extend from the left edge 18 of the blank 10 depicted in FIG. 1. The first extended portion 22 extends from the left edge 18 of the blank 10 along the first truncated fold line 58, and the fourth extended portion 28 extends from the left edge 18 of the blank 10 along the fourth truncated fold line 64. Similarly, the second extended portion 24 and the third extended portion 26 extend from the right edge 14 of the blank 10 depicted in FIG. 1. The second extended portion 24 extends from the right edge 14 of the blank 10 along the second truncated fold line 60, and the third extended portion 26 extends from the right edge 14 of the blank 10 along the third truncated fold line 62. Each of these four extended portions 22, 24, 26, 28 comprises two crisscross panels 20. As may be seen in FIG. 1, there are thirty-two crisscross panels 20 on the blank 10, each of which is substantially the same size. Each crisscross panel 20 is pre-creased in an X-shaped pattern to facilitate formation of the ends of the containers depicted in FIGS. 4C, 5C, 6C, 7E, 8D, 9D, 10E, 11D, and 12D. The pre-creasing or scoring facilitates bending and shaping of the blank 10 along these pre-shaped, pre-scored, or pre-creased lines.

Figure 2:
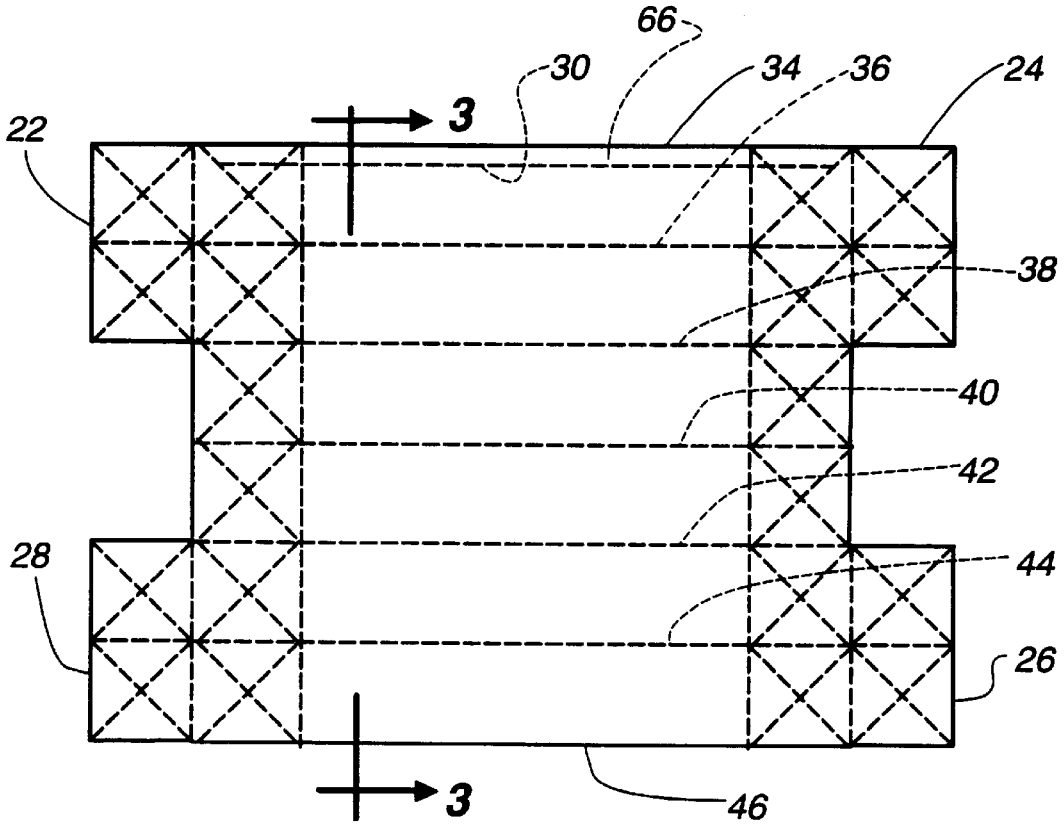
FIG. 2 is the blank of FIG. 1 assembled into a flat precursor or preliminary configuration from which various containers are made.
Figure 3:
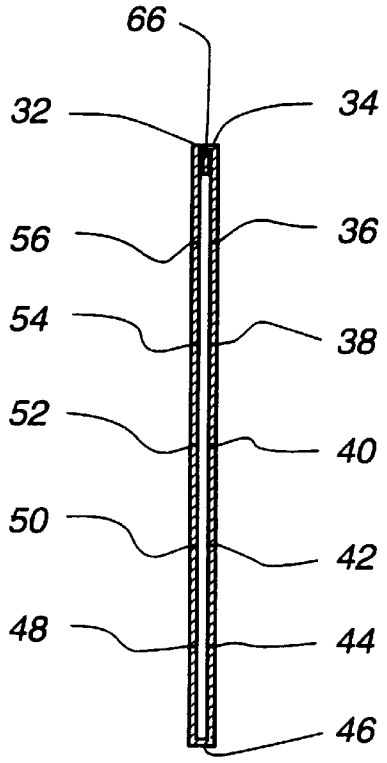
FIG. 3 is a cross-sectional view along line 3—3 of FIG. 2 showing the thin profile of the preliminary configuration.

Referring to FIGS. 1, 2, and 3, the steps for preparing the blank 10 depicted in FIG. 1 to be folded into one of the nine depicted sample configurations (FIGS. 4C, 5C, 6C, 7E, 8D, 9D, 10E, 11D, and 12D) are described next. The configuration depicted in FIG. 2 is formed by folding the glue tab 66 against the back surface of the blank 10 by folding the top edge 30 180° toward the back side of the blank 10 (i.e., into the paper in FIG. 1) along the first fold line 34. The resulting configuration of the glue tab 66 is shown in phantom in FIG. 2 and is clearly visible in FIG. 3. Then, the exposed side of the glue tab 66 is brought adjacent the bottom edge 32 by folding the blank 10 along its seventh fold line 46. In other words, referring to FIG. 1, the material below the seventh fold line 46 is folded backward (i.e., into the paper in FIG. 1) 180° until the bottom edge 32 is adjacent the glue tab 66, which has been folded downward 180° (i.e., into the paper in FIG. 1). When these two 180° bends are made in the blank 10 depicted in FIG. 1 along the first fold line 34 and the seventh fold line 46, the blank 10 then has the configuration shown in FIGS. 2 and 3. With the blank 10 thus folded, the exposed side of the glue tab 66 is subsequently glued or taped to what will become the inside of the container adjacent the bottom edge 32 of the blank 10 as depicted in FIG. 3. Therefore, if the front sides of the first extended portion 22, the second extended portion 24, the third extended portion 26, and the fourth extended portion 28 are visible in FIG. 1, then, in FIG. 2, the front side of the first and second extended portions 22, 24, respectively, are still visible, but the back side of the third and fourth extended portions 26, 28, respectively, are visible. In FIGS. 2 and 3, the blank 10 is in the precursor or preliminary configuration that may be folded into one of several possible container shapes.

Although the creased, but as yet unfolded, blank 10 depicted in FIG. 1 is easily shipped and requires a minimum amount of shipping space, the precursor configuration depicted in FIG. 2 requires an equal volume of shipping space but may be easier to handle. Also, in the precursor configuration depicted in FIGS. 2 and 3, where the glue tab 66 has been attached to the back side of the bottom panel adjacent the bottom edge 32, the blank 10 is now ready to be formed into one of the nine depicted container shapes, among others.

Figure 7A:
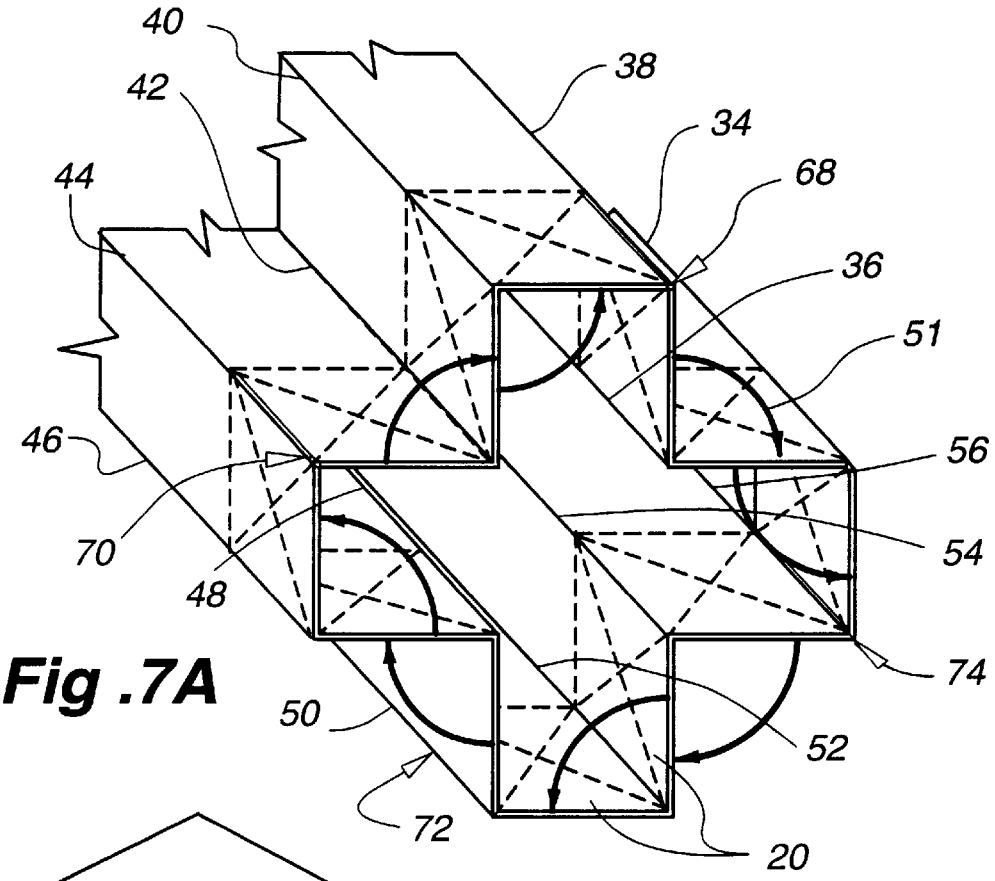
FIGS. 7A, 7B, 7D, and 7E depict steps for forming a one-unit volume container from the blank depicted in FIG. 1.
Figure 7B:
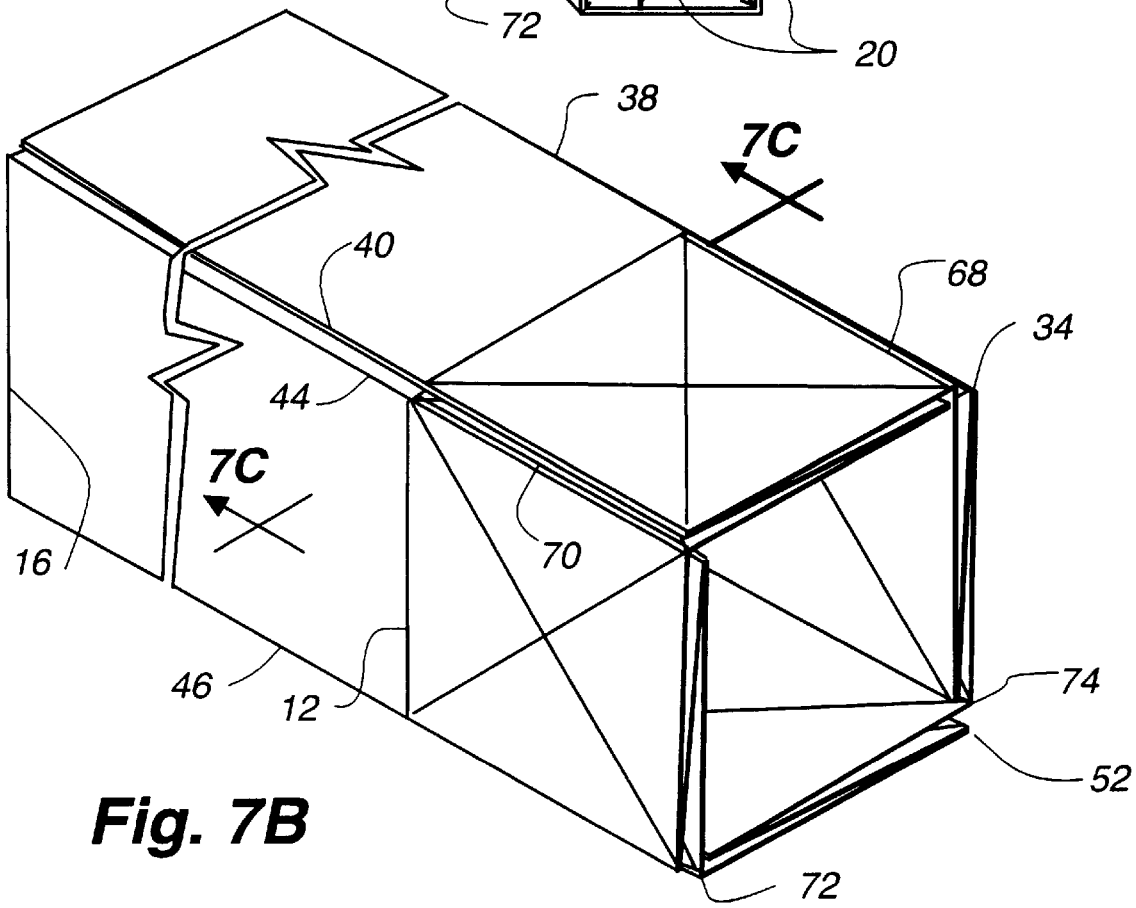
Figure 7C:
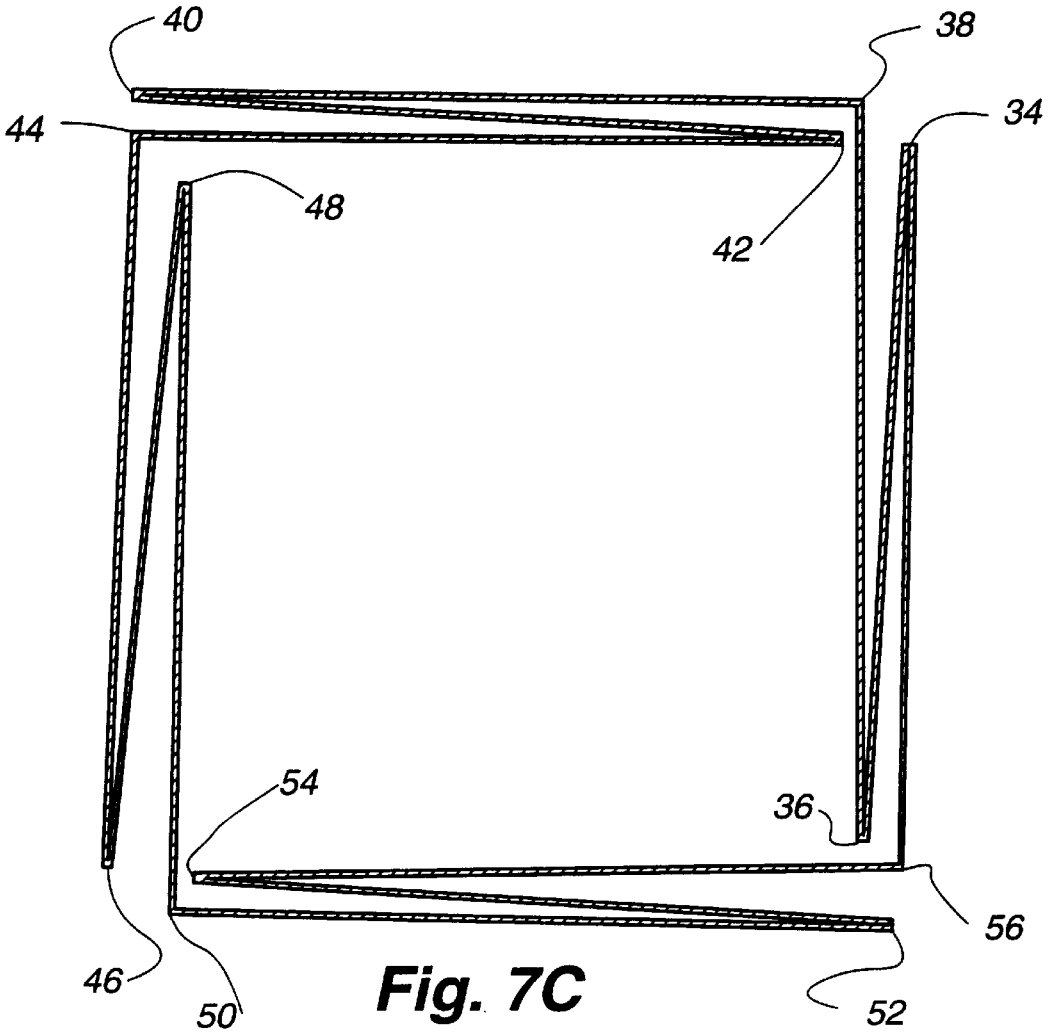
FIG. 7C is a cross-sectional view along line 7C—7C of FIG. 7B showing several folds in the blank depicted in FIG. 1.
Figure 7D:
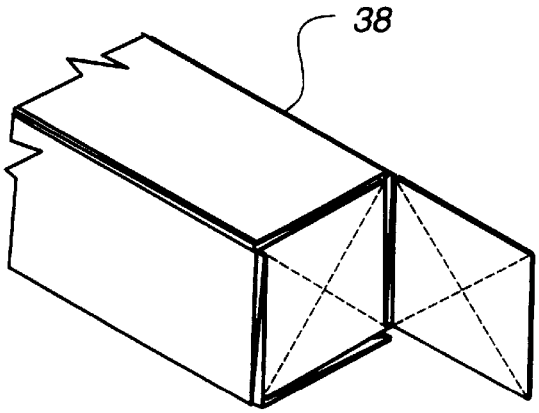
Figure 7E:
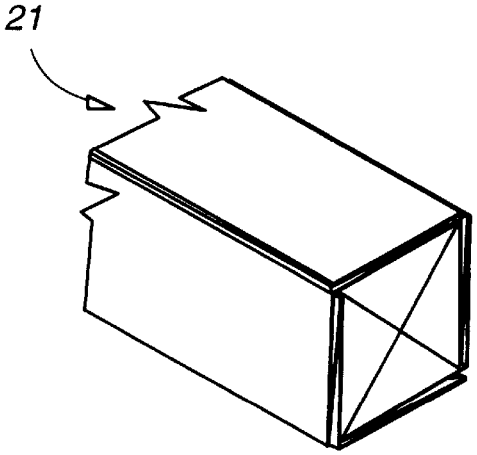
Figure 12D:
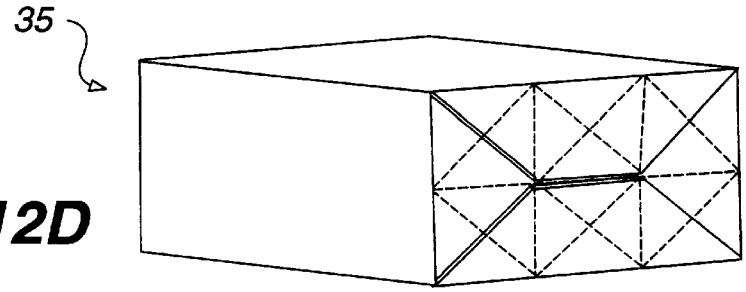
FIGS. 12A, 12C, and 12D depict steps for forming a six-unit volume container from the blank depicted in FIG. 1.
Figure 12C:
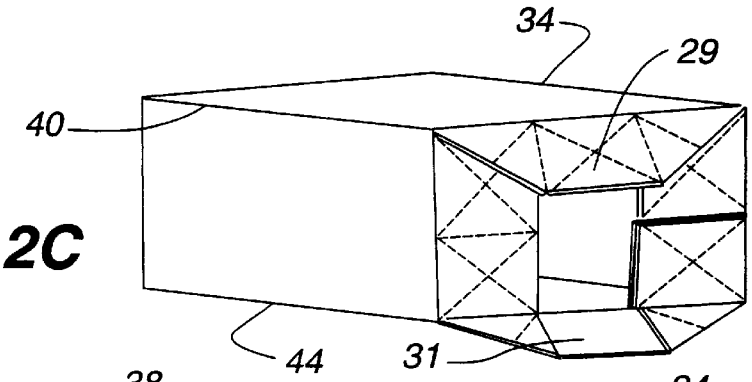

As used herein with reference to the blank 10 depicted in FIG. 1, a "unit volume" is equal to the volume occupied by a hexahedron in the form of a right parallelepiped (or an elongate cube), whose cross-sectional area perpendicular to its longitudinal axis is substantially a square having the dimensions of a crisscross panel 20, and the length of whose longest side is substantially equal to the perpendicular distance between the first ancillary fold line 16 and the second ancillary fold line 12. For example, the container 21 depicted in FIG. 7E is a one-unit volume container, and the container 35 depicted in FIG. 12D is a six-unit volume container.

Figure 4C:
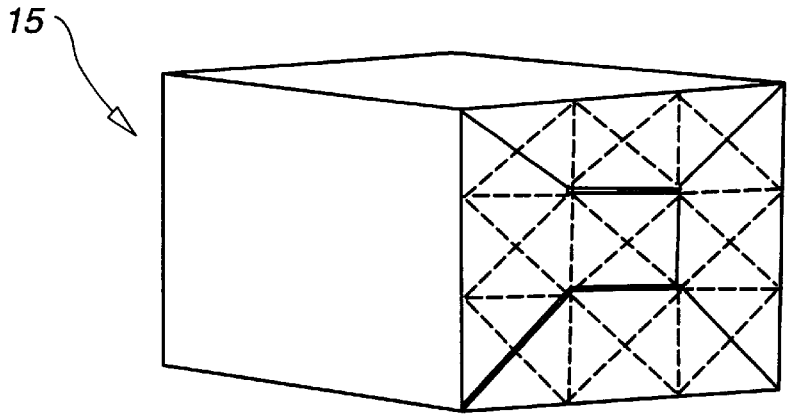
FIGS. 4A, 4B, and 4C depict steps for forming a nine-unit volume container from the blank of FIG. 1.
Figure 4B:
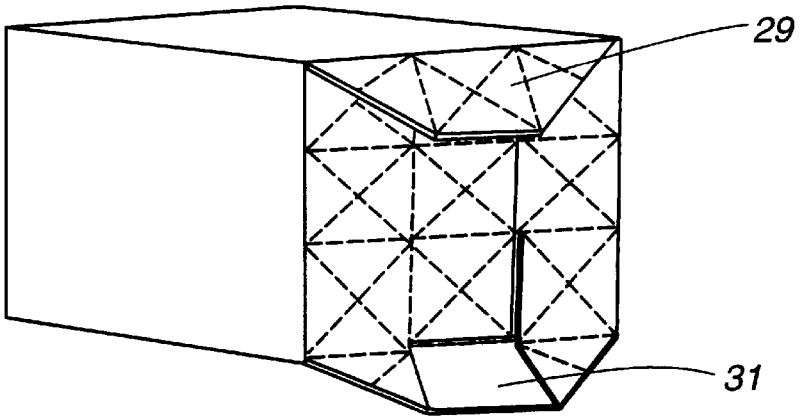
Figure 4A:
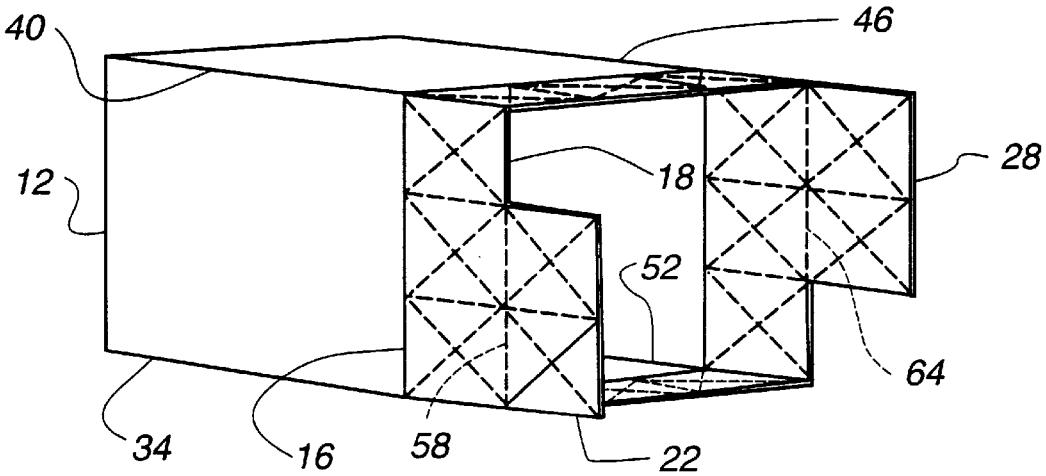

Referring to FIGS. 4A, 4B, and 4C, the steps for folding the blank 10 depicted in FIG. 1 from its preliminary configuration depicted in FIG. 2 into a container 15 (FIG. 4C) having a nine-unit volume are depicted. To fold the blank 10 into the nine-unit volume container 15 depicted in FIG. 4C, it is unnecessary to remove any material from the blank 10 or to make any additional cuts. In other words, the blank 10 as it is depicted in FIG. 2 may be directly folded into the nine-unit volume container 15 depicted in FIG. 4C. After opening and folding the blank 10 depicted in FIG. 2 to represent the shape depicted in FIG. 4A, ends are formed by making various additional folds along pre-creased lines. One end of the nine-unit container 15 depicted in FIG. 4C has already been closed in FIGS. 4A and 4B. The basic steps for closing the remaining end of the container 15 are depicted in FIGS. 4A and 4B. Referring first to FIG. 4A, a first fold is made along a portion of the first ancillary fold line 16. In particular, the first extended portion 22 and the nearest three crisscross panels 20 attached to the first extended portion 22 (visible in FIG. 4A) are folded toward the center of the container 15 along the portion of the first ancillary fold line 16 adjoining the just-referenced three crisscross panels 20 (i.e., along the portion of the first ancillary fold line 16 between the first fold line 34 and the fourth fold line 40). A similar fold is made along the portion of the first ancillary fold line 16 adjoining the three crisscross panels 20 visible on the right-hand side of FIG. 4A and attached to the fourth extended portion 28 (i.e., along the portion of the first ancillary fold line 16 between the seventh fold line 46 and the tenth fold line 52). Looking at both FIGS. 4A and 4B, it is apparent that it is also necessary to fold along four of the pre-creased lines in order to obtain the partially folded configuration depicted in FIG. 4B. To completely close the container, the trapezoid-shaped top and bottom flaps 29, 31, respectively, are folded toward the center of the container 15. These two trapezoid-shaped flaps 29, 31 hold the ten crisscross panels (one crisscross panel from the first extended portion 22 overlaps a crisscross panel from the fourth extended portion 28 when the container 15 is closed) that seal the end of the container 15 closed.

Figure 5C:
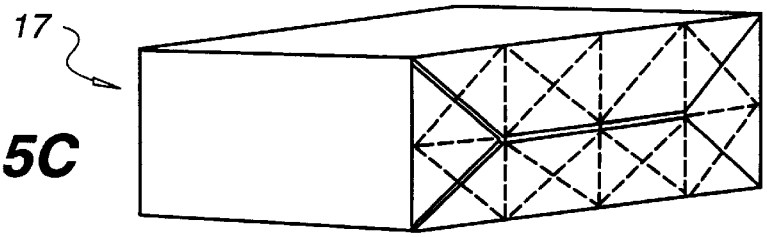
FIGS. 5A, 5B, and 5C depict steps for forming an eight-unit volume container from the blank of FIG. 1.
Figure 5B:
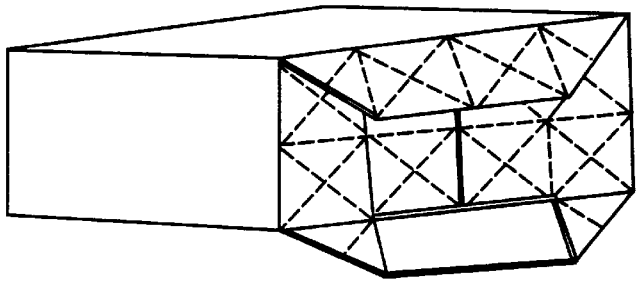
Figure 5A:
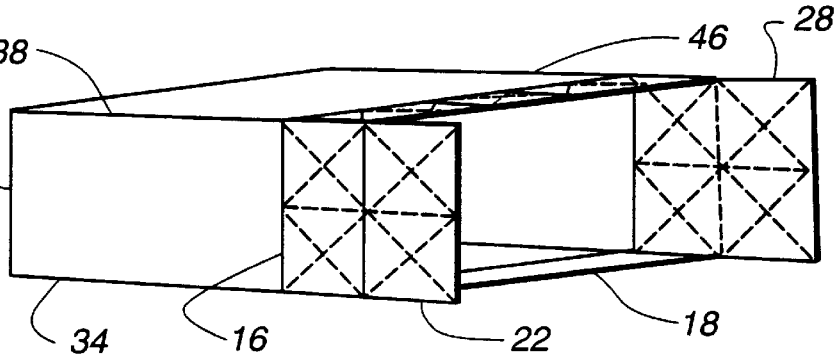

The eight-unit volume container 17 depicted in FIGS. 5A, 5B, and 5C may be easily formed by folding the assembled blank 10 of FIG. 2. To fold the blank 10 into the eight-unit volume container 17 depicted in these figures, it is unnecessary to remove any material from the blank 10 or to make any additional cuts. In other words, the blank 10 as it is depicted in FIG. 2 may be directly folded into the eight-unit volume container 17 depicted in FIG. 5C.

Figure 6C:
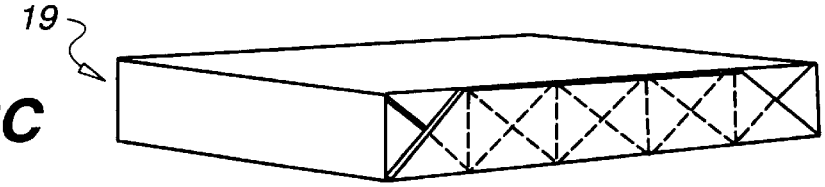
FIGS. 6A, 6B, and 6C depict steps for forming of a five-unit volume container from the blank depicted in FIG. 1.
Figure 6B:
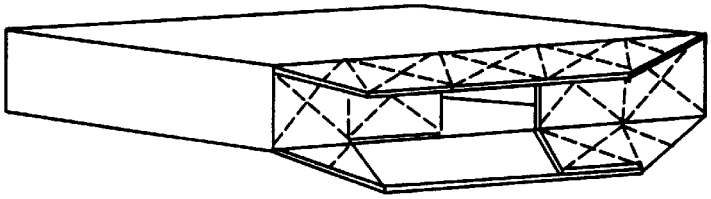
Figure 6A:
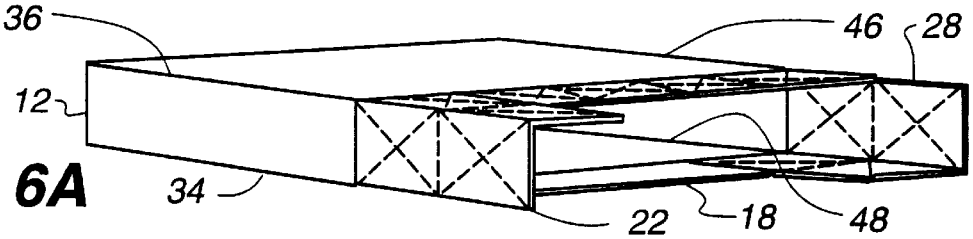

FIGS. 6A, 6B, and 6C depict the steps for folding the blank 10 depicted in FIG. 2 into a five-unit volume container 19 (FIG. 6C). As depicted in these figures, the end that is not fully visible has already been closed. By referring first to FIG. 6A, then 6B, and then 6C, it is clear how to fold the blank 10 depicted in FIG. 2 into the completed five-unit volume container 19 depicted in FIG. 6C. In order to make the completed container 19 depicted in FIG. 6C, it is unnecessary to remove any material from the blank 10 or to cut the blank 10.

Depicted in FIG. 7E is a one-unit volume container 21, which is the smallest container easily formed from the blank 10 depicted in FIG. 1. A preferred method of forming the one-unit volume container 21 depicted in FIG. 7E may be seen from reviewing FIGS. 7A, 7B, 7C, 7D, and 7E in that order. To facilitate easier assembly of the one-unit volume container 21 depicted in FIG. 7E, it is desirable to first remove the four extended portions 22, 24, 26, 28 (FIG. 1) comprising two crisscross panels 20 each. Also, as depicted in FIG. 7A, it is necessary to make at least four cuts 68, 70, 72, 74 on the blank 10 depicted in FIG. 1. These four cuts 68, 70, 72, 74 permit the remaining twenty-four crisscross panels 20 (twelve on each end) to be folded to make the ends for the one-unit volume container 21.

As shown in FIG. 7A, each of the four cuts 68, 70, 72, 74 is one crisscross panel 20 deep, and each cut is separated from the next by three connected crisscross panels 20. For example, a first one-crisscross-panel-deep cut 68 could be made as shown in FIG. 7A along the third fold line 38, a similar second cut 70 could be made along the sixth fold line 44, a similar third cut 72 could be made along the ninth fold line 50, and a similar fourth and final cut 74 could be made along the twelfth fold line 56. Then, as shown by the eight arcuate lines in FIG. 7A (one of which is labeled 51 for illustration), various pre-formed panels 11 must be folded against one another. For example, starting at approximately the three o'clock position (as shown in FIG. 7A) and working counterclockwise, the pre-formed panel between the first fold line 34 and the second fold line 36 is folded downward along the first fold line 34 until that panel rests against the pre-formed panel between the first fold line 34 and the twelfth fold line 56. Similarly, the pre-formed panel between the second fold line 36 and the third fold line 38 is folded against the pre-formed panel between the first fold line 34 and the second fold line 36 by folding along the second fold line 36 as shown. The pre-formed panel between the fourth fold line 40 and the fifth fold line 42 is folded against the pre-formed panel between the third fold line 38 and the fourth fold line 40 by folding along the fourth fold line 40 as shown. The pre-formed panel between the fifth fold line 42 and the sixth fold line 44 is folded against the pre-formed panel between the fourth fold line 40 and the fifth fold line 42 along the fifth fold line 42 as shown. The pre-formed panel between the seventh fold line 46 and the eighth fold line 48 is folded against the pre-formed panel between the sixth fold line 44 and the seventh fold line 46 by folding along the seventh fold line 46 as shown. The pre-formed panel between the eighth fold line 48 and the ninth fold line 50 is folded against the pre-formed panel between the seventh fold line 46 and the eighth fold line 48 by folding along the eighth fold line 48 as shown. The pre-formed panel between the tenth fold line 52 and the eleventh fold line 54 is folded against the pre-formed panel between the ninth fold line 50 and the tenth fold line 52 by folding along the tenth fold line 52 as shown. The pre-formed panel between the eleventh fold line 54 and the twelfth fold line 56 is folded against the pre-formed panel between the tenth fold line 52 and the eleventh fold line 54 by folding along the eleventh fold line 54 as shown. Shortly before each of these folds is completed, the configuration depicted in FIGS. 7B and 7C is attained. Then, as depicted in FIG. 7D, the resulting stacked groups of crisscross panels 20 are folded toward the center of the container 21 to close off its end, resulting in the closed, one-unit volume container 21 depicted in FIG. 7E.

By closer examination of FIGS. 7A, 7B, and 7C, it is apparent that the four "sides" or "ends" of the cross or plus sign shown in FIG. 7A become the four exposed sides of the resulting one-unit volume container 21. These four sides comprise the panels between the third and fourth fold lines 38, 40, respectively; the sixth and seventh fold lines 44, 46, respectively; the ninth and tenth fold lines 50, 52, respectively; and the twelfth and first fold lines 56, 34, respectively.

Figure 8D:
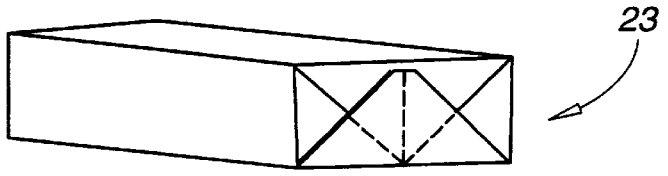
FIGS. 8A, 8C, and 8D depict steps for forming a two-unit volume container from the blank depicted in FIG. 1.
Figure 8C:
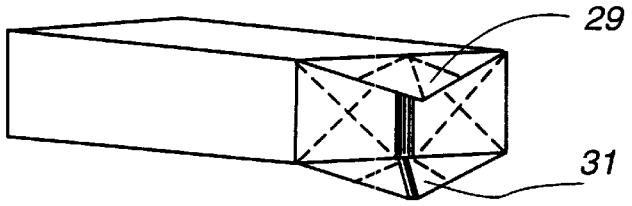
Figure 8B:
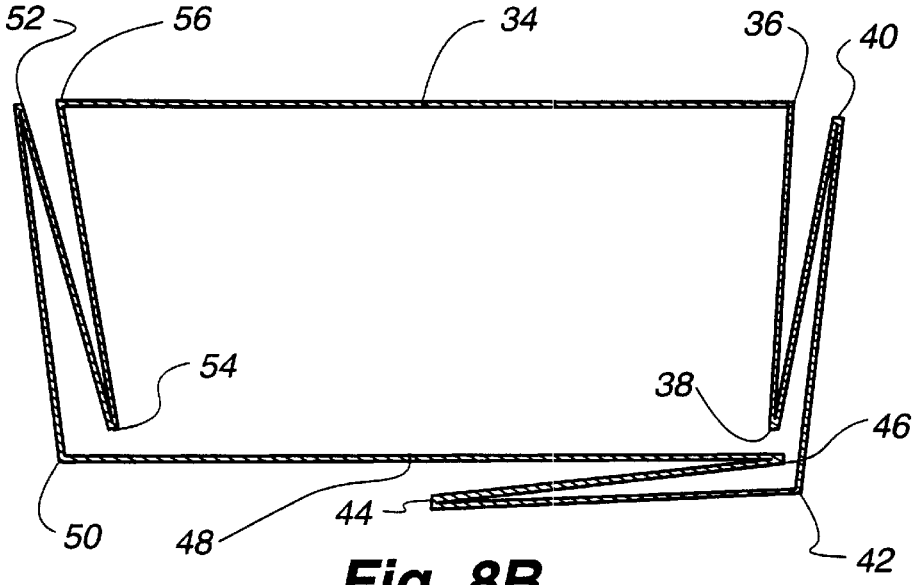
FIG. 8B is a cross-sectional view along line 8B—8B of FIG. 8A showing several folds in the blank depicted in FIG. 1.
Figure 8A:
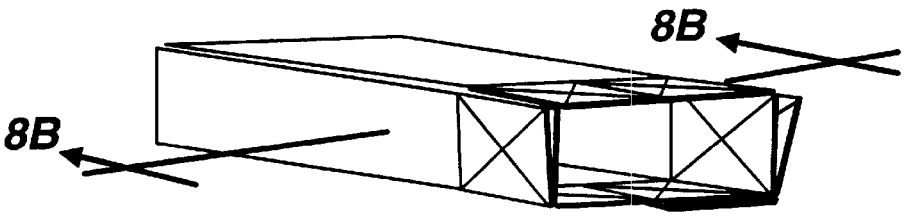

Referring now to FIGS. 8A, 8B, 8C, and 8D, a preferred series of steps for folding the blank 10 depicted in FIG. 1 into the two-unit volume container 23 depicted in FIG. 8D are described. Before attempting to fold the blank 10 into this two-unit volume configuration, it is preferable to remove the four extended portions 22, 24, 26, 28 comprising two crisscross panels 20 each. No additional changes to the blank 10 are required. FIG. 8A depicts the configuration of the two-unit volume container 23 after several initial folds have been made in the blank 10 depicted in FIG. 1. FIG. 8B is a cross-sectional view along line 8B—8B of FIG. 8A showing the position of each of the twelve pre-formed panels 11. As clearly shown in FIG. 8B, the two short walls of the resulting two-unit volume container 23 each ends up being triple thickness, and one-half of the bottom portion of the container also ends up being triple thickness. This is one method of forming the blank 10 into a two-unit volume container 23, but the blank 10 may be folded differently and still result in a two-unit volume container 23. Once the basic container 23 is formed as depicted in FIGS. 8A and 8B, the ends must be formed to complete the container 23. FIG. 8C shows how the crisscross panels 20 are folded to form an end. Once the triangular-shaped end top flap 29 and bottom flap 31 shown in FIG. 8C are folded completely over, the completed two-unit volume container 23 depicted in FIG. 8D results.

Figure 9D:
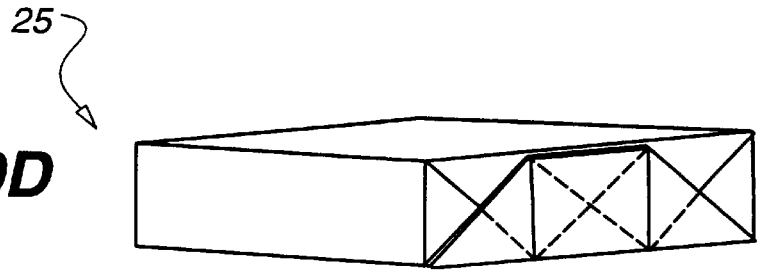
FIGS. 9A, 9C, and 9D depict steps for forming a three-unit volume container from the blank depicted in FIG. 1.
Figure 9C:
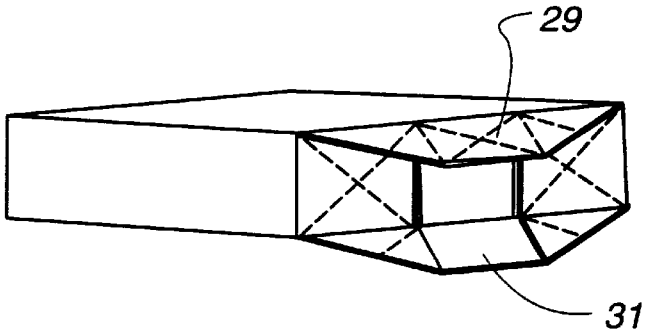
Figure 9B:
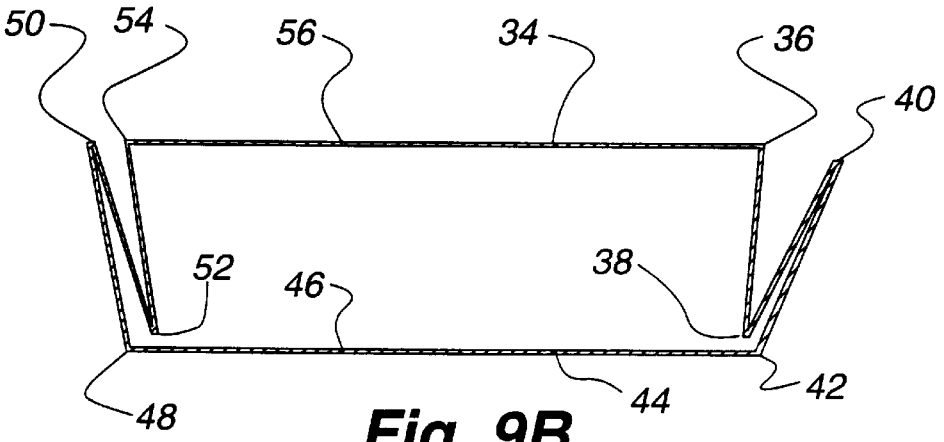
FIG. 9B is a cross-sectional view along line 9B—9B of FIG. 9A showing several folds in the blank depicted in FIG. 1.
Figure 9A:
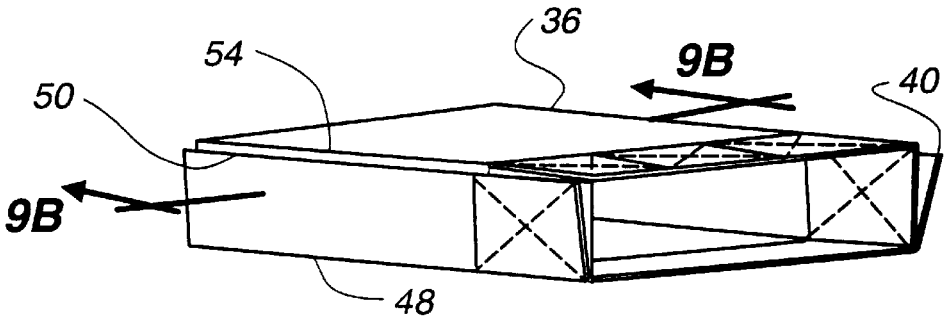

Referring now to FIGS. 9A, 9B, 9C, and 9D, a preferred series of steps for folding the blank 10 depicted in FIG. 1 into the three-unit volume container 25 depicted in FIG. 9D is described. After a series of initial folds along primary fold lines are made in the blank 10 depicted in FIG. 2, the configuration depicted in FIG. 9A is attained. As depicted in FIG. 9A, the least visible end of the three-unit volume container 25 is already closed. The orientation of the twelve pre-formed panels 11 in this preferred series of steps for obtaining the container 25 of FIG. 9D are clearly visible in FIG. 9B, which is a cross-sectional view along line 9B—9B of FIG. 9A. As depicted in FIG. 9B, the top of the resulting container 25 will be one panel thick as will be the bottom. The left side and the right side of the resulting container 25 will be triple thickness as also shown in FIG. 9B. The three pre-formed panels 11 comprising the left side (as shown in FIG. 9B) are those between the eighth fold line 48 and the ninth fold line 50, between the ninth fold line 50 and the tenth fold line 52, and between the tenth fold line 52 and the eleventh fold line 54. Similarly, the three pre-formed panels 11 comprising the right side (as shown in FIG. 9B) are those between the second fold line 36 and the third fold line 38, between the third fold line 38 and the fourth fold line 40, and between the fourth fold line 40 and the fifth fold line 42. After the initial folds have been made as depicted in FIGS. 9A and 9B, the crisscross panels 20 are folded toward the inside of the container to attain the intermediate configuration depicted in FIG. 9C. FIG. 9C shows the container 25 with a partially closed end and two trapezoid-shaped end flaps 29, 31 ready to be closed. Once these two trapezoid-shaped flaps 29, 31 are closed, the three-unit volume container 25 depicted in FIG. 9D results.

Figure 10B:
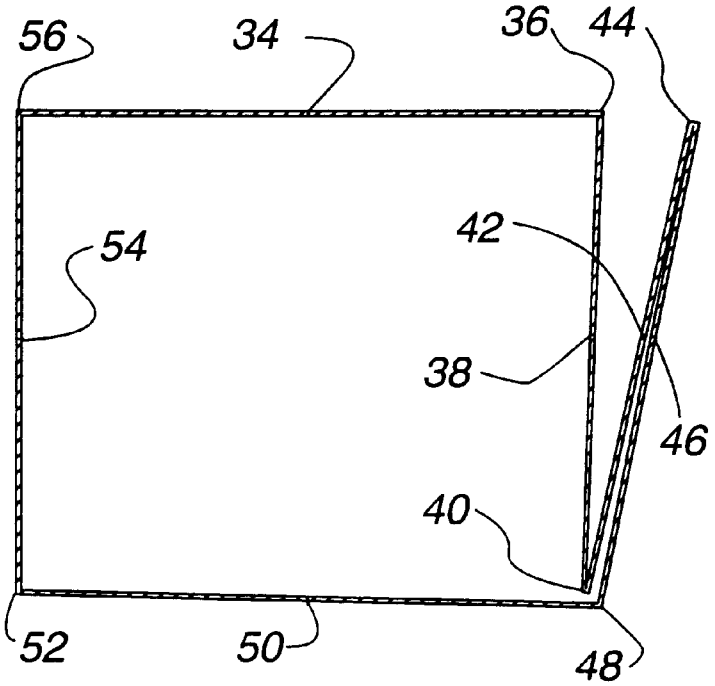
FIG. 10B is a cross-sectional view along line 10B—10B of FIG. 10A showing several folds in the blank depicted in FIG. 1.
Figure 10A:
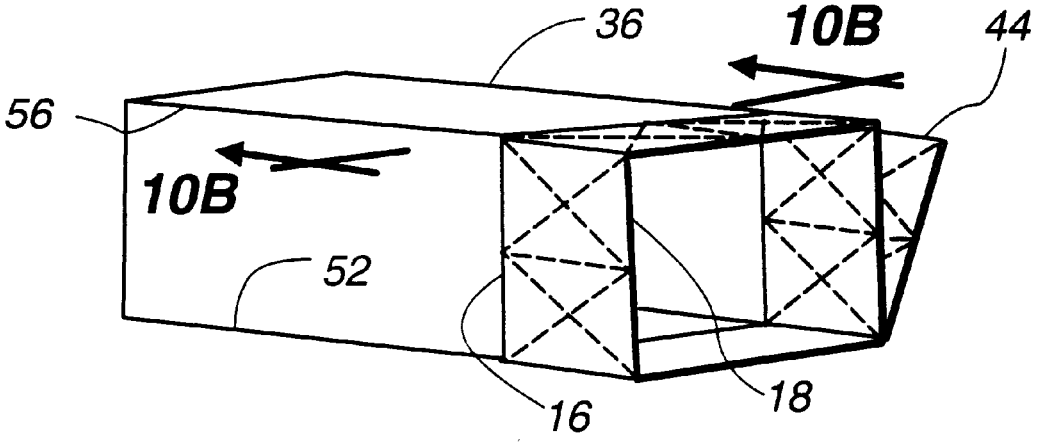
FIGS. 10A, 10D, and 10E depict steps for forming one possible configuration of a four-unit volume container from the blank depicted in FIG. 1.
Figure 10E:
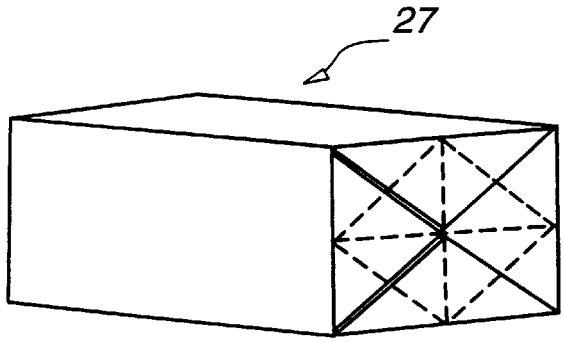

Referring now to FIGS. 10A, 10B, 10C, 10D, and 10E, a preferred set of steps for forming the four-unit volume container 27 depicted in FIG. 10E from the blank 10 depicted in FIG. 1 is described next. Before beginning to fold the blank 10 into the container 27 depicted in FIG. 10E, and to facilitate folding, the four extended portions 22, 24, 26, 28, comprising two crisscross panels 20 each, should be removed from the blank 10. No additional changes to the blank 10 are required. After some initial folds are made to the blank 10 depicted in FIG. 2, the configuration depicted in FIG. 10A is achieved. A cross-sectional view of this intermediate configuration of the container is depicted in FIG. 10B, which is a cross-sectional view along line 10B—10B of FIG. 10A. The configuration depicted in FIGS. 10A and 10B places the "excess" blank material on the right-hand side of the container. The "excess" material is, for example, the material between the fourth fold line 40 and the eighth fold line 48. Alternatively, the "excess" material is the material between the second fold line 36 and the sixth fold line 44.

Figure 10D:
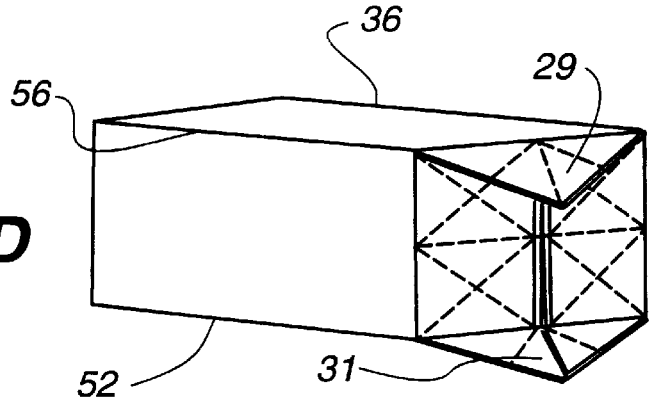
Figure 10C:
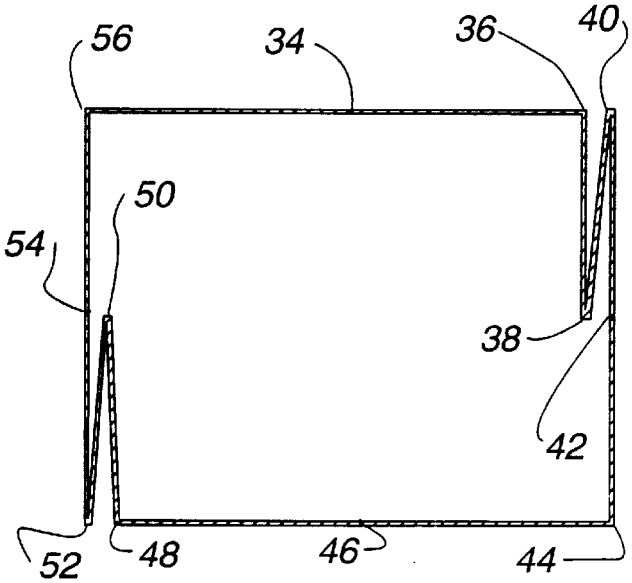
FIG. 10C is an alternative cross-sectional view similar to FIG. 10B, but showing another way of folding the blank depicted in FIG. 1 into a four-unit volume container.

An alternative folding pattern to attain a four-unit volume container 27 is depicted in FIG. 10C, which is a cross-sectional view from the same perspective as that of FIG. 10B. The configuration depicted in FIG. 10C places the "excess" blank material on two sides of the container 27. The "excess" material is, for example, the material between the eighth fold line 48 and the tenth fold line 52, and the material between the second fold line 36 and the fourth fold line 40. In the alternative, the "excess" material is the material between the ninth fold line 50 and the eleventh fold line 54, and the material between the third fold line 38 and the fifth fold line 42. In each alternative folding pattern (FIG. 10B and FIG. 10C), four "excess" panels are concealed.

From the intermediate configuration having the cross-section of FIG. 10C or FIG. 10B, the crisscrossed end panels 20 are folded to attain the triangular end flaps 29, 31 depicted in FIG. 10D. To complete the container, the triangular end flaps 29, 31 are folded toward the inside of the container resulting in the completed container 27 of FIG. 10E.

Figure 11D:
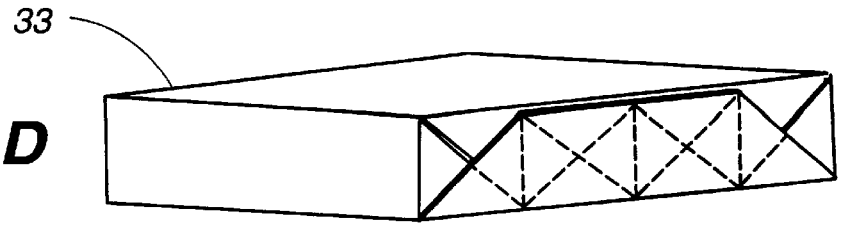
FIGS. 11A, 11C, and 11D depict steps for closing an end of a second possible four-unit volume container made from the blank depicted in FIG. 1.
Figure 11C:
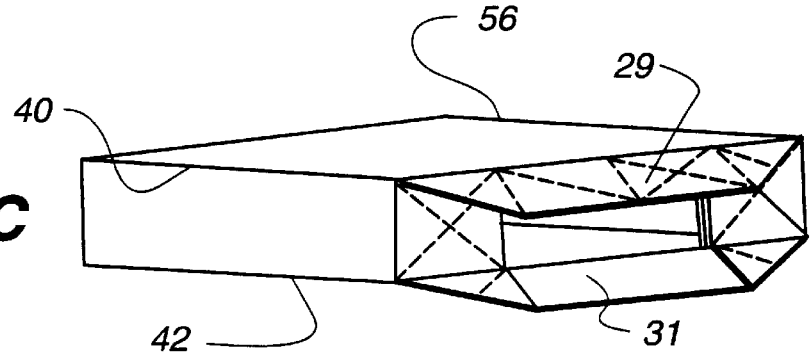
Figure 11B:
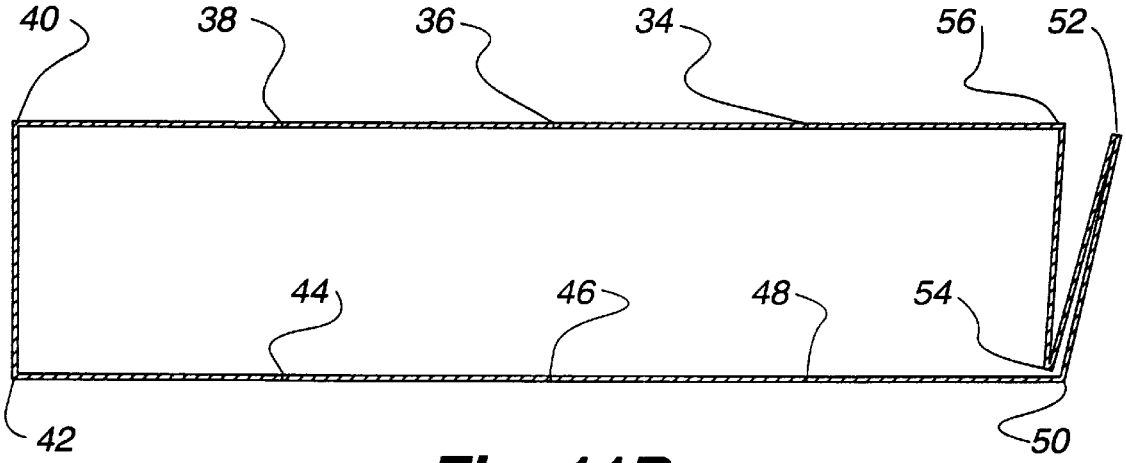
FIG. 11B is a cross-sectional view along line 11B—11B of FIG. 11A showing several folds in the blank depicted in FIG. 1.
Figure 11A:
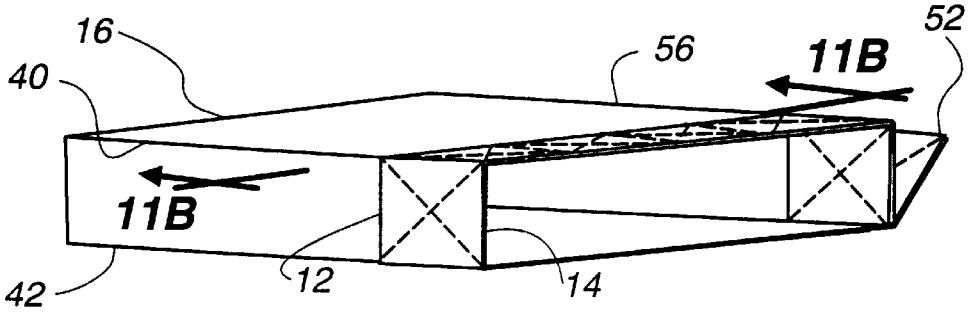

Referring now to FIGS. 11A, 11B, 11C, and 11D, a preferred set of folds for attaining the four-unit volume container 33 depicted in FIG. 11D from the blank 10 depicted in FIG. 1 is next described. Before making the folds in the blank 10, it is desirable to remove the four extended portions 22, 24, 26, 28, comprising two crisscross panels 20 each. The removal of this excess material makes it easier to fold the blank 10 into the ultimate configuration depicted in FIG. 11D. No additional changes to the blank 10 are required. Following steps similar to those previously discussed, the intermediate configuration depicted in FIG. 11A may be attained. FIG. 11B is a cross-sectional view about line 11B—11B of FIG. 11A and shows placement of the "excess" material on the right side (as shown in FIG. 11B) of the container 33. The "excess" material is, for example, the material between the tenth fold line 52 and the twelfth fold line 56, or the material between the ninth fold line 50 and the eleventh fold line 54. The side of the container on which the "excess" material ends up is unimportant. The end of the container is closed by making the appropriate folds to create the trapezoid-shaped end flaps 29, 31 depicted in FIG. 11C. Once these trapezoid-shaped end flaps 29, 31 are folded toward the interior of the container, the completed container 33 depicted in FIG. 11D is attained. As shown (FIGS. 11A and 11B), the two panels 11 between the tenth fold line 52 and the twelfth fold line 56 are concealed.

Figure 12B:
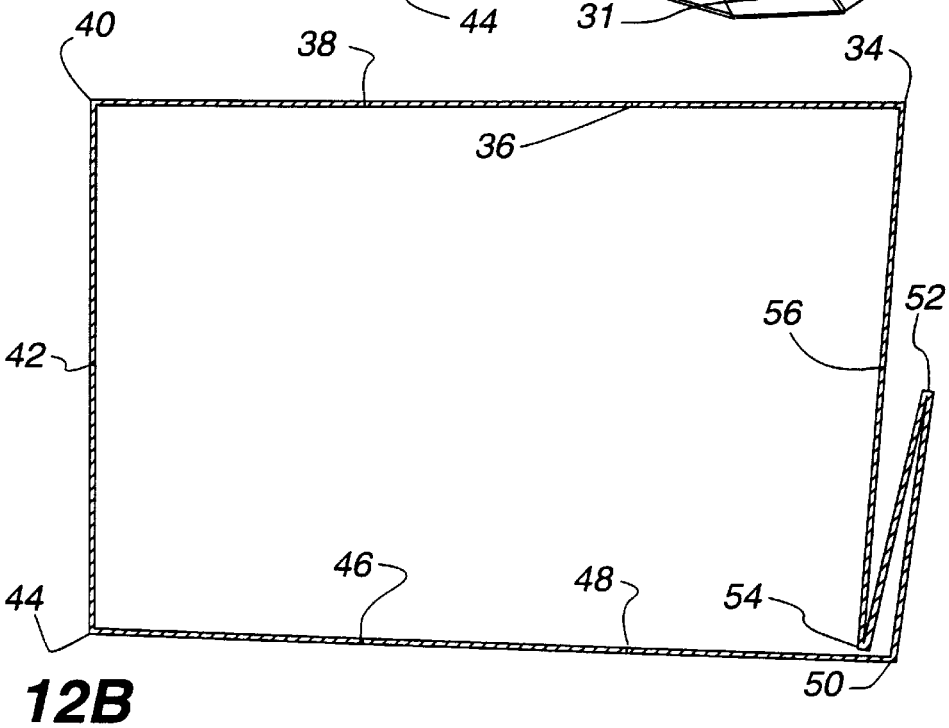
FIG. 12B is a cross-sectional view along line 12B—12B of FIG. 12A showing several folds in the blank depicted in FIG. 1.
Figure 12A:
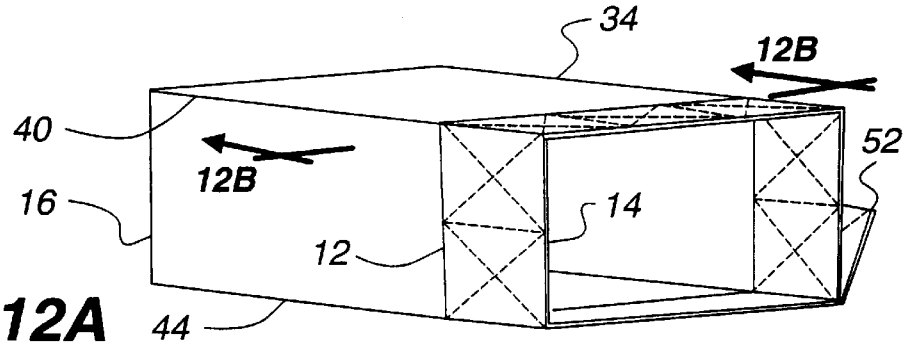

Referring now to FIGS. 12A, 12B, 12C, and 12D, preferred steps for forming the six-unit volume container 35 depicted in FIG. 12D from the blank 10 depicted in FIG. 1 is next described. Before any of the folds depicted in FIGS. 12A, 12B, 12C, or 12D is made, it is preferable that the four extended portions 22, 24, 26, 28, most clearly visible in FIGS. 1 and 2, each comprising two crisscross panels 20, be removed. No additional changes to the blank 10 are required. As depicted in FIGS. 12A and 12B, the excess box material ends up on the lower right-hand side of the resulting container 35 depicted in FIG. 12D. FIG. 12B is a cross-sectional view about line 12B—12B of FIG. 12A and shows placement of the "excess" material. As was the case with the four-unit volume container 33 depicted in FIG. 11D, the "excess" material in the six-unit volume container 35 depicted in FIG. 12D is, for example, the material between the tenth fold line 52 and the twelfth fold line 56, or the material between the ninth fold line 50 and the eleventh fold line 54. Thus, the lower right-hand portion of the right-hand container wall ends up being three times as thick as the remainder of the container's side walls. From the intermediate configuration depicted in FIG. 12A, appropriate folds are made to obtain the configuration depicted in FIG. 12C, where two trapezoid-shaped end flaps 29, 31 have been created. Once these trapezoid-shaped end flaps 29, 31 are folded toward the interior of the container, the complete and closed container 35 depicted in FIG. 12D is attained.

Figure 13:
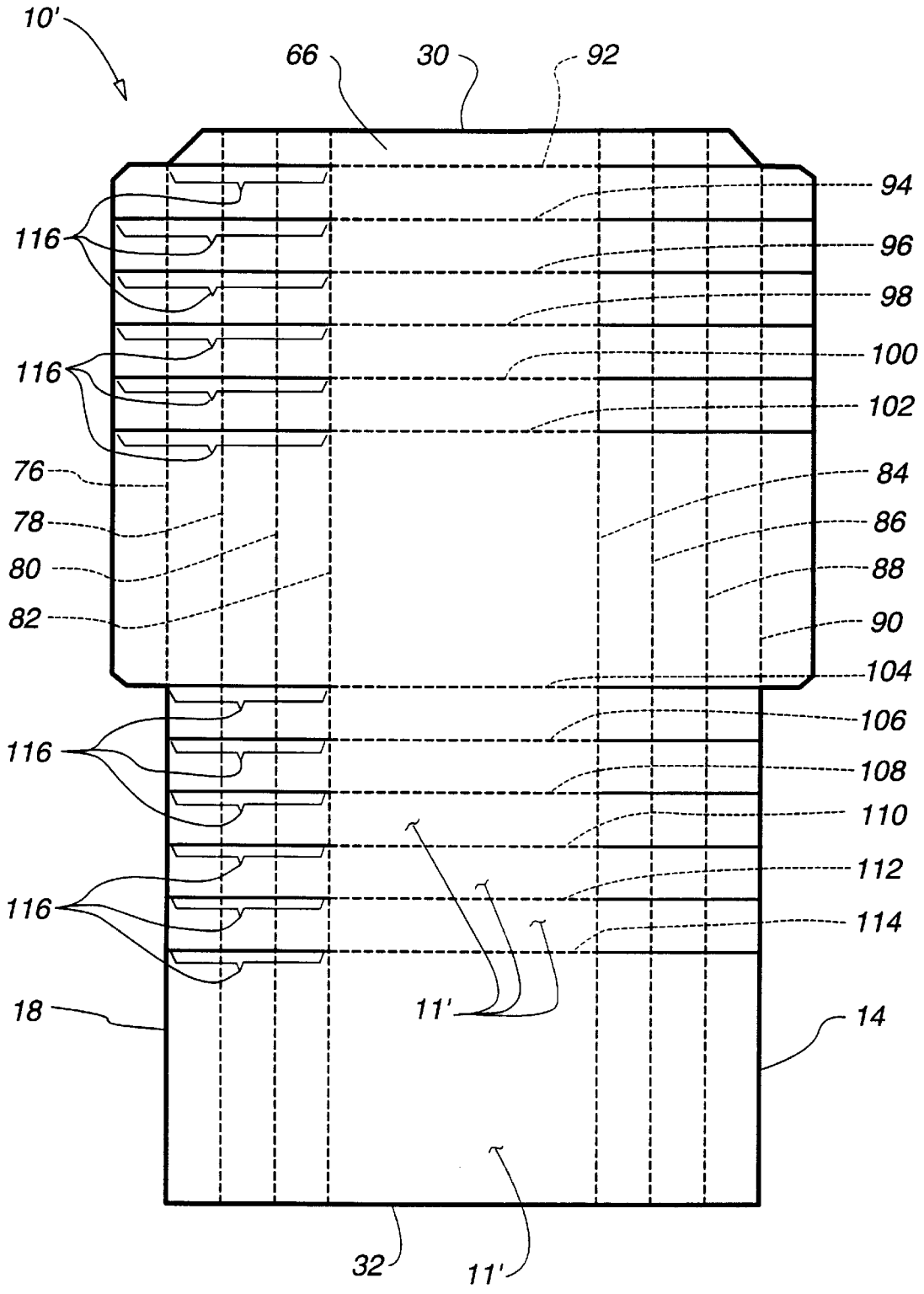
FIG. 13 is an overall planform view of a second embodiment of a blank used to make various containers.
Figure 14:
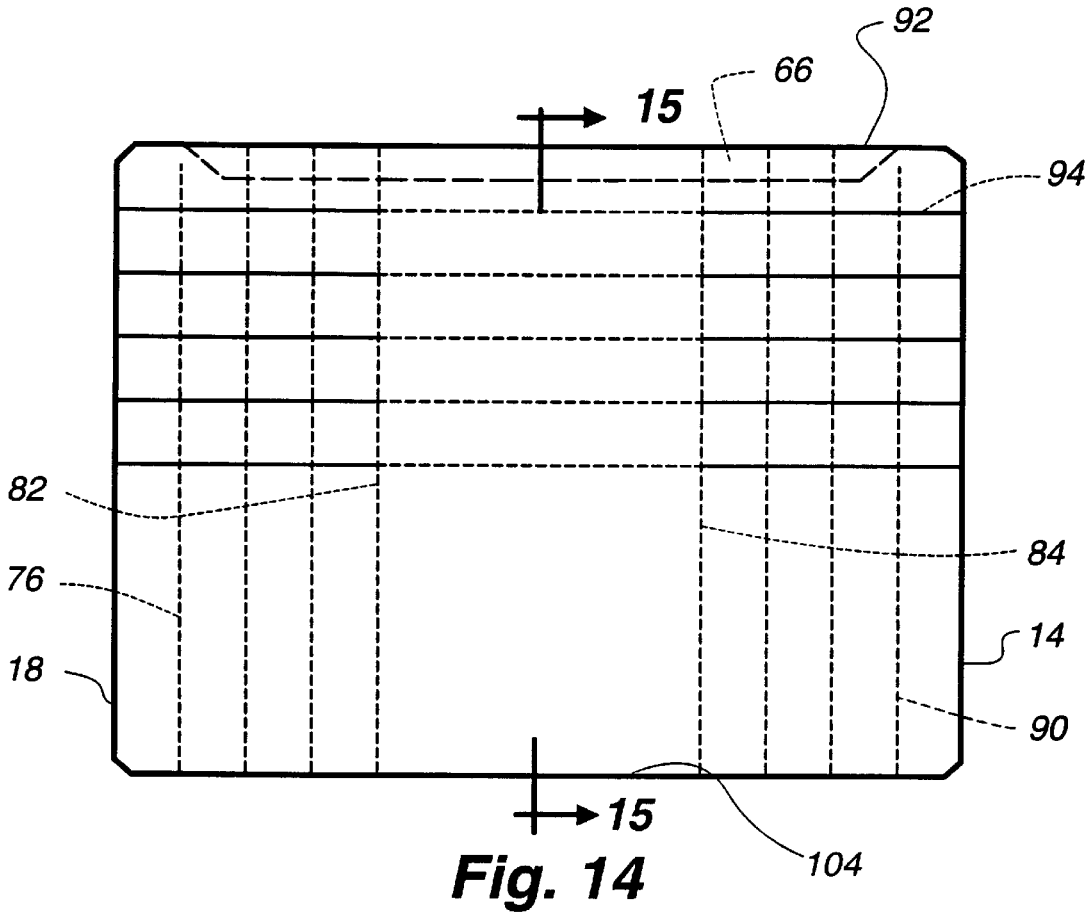
FIG. 14 is the blank depicted in FIG. 13 assembled into a flat precursor or preliminary configuration from which various containers are made.
Figure 15:
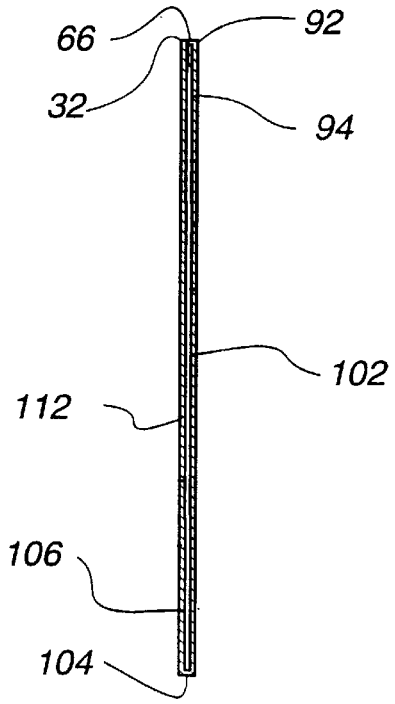
FIG. 15 is a cross-sectional view along line 15—15 of FIG. 14 showing the thin profile of the preliminary configuration.

Referring now to FIGS. 13, 14, and 15, a second preferred embodiment of the invention is described. FIG. 13 depicts the blank 10' in a laid-out configuration (i.e., before it has been formed into a precursor or preliminary configuration depicted in FIGS. 14 and 15 that may be folded into one of several possible container shapes). In this preferred embodiment, the blank 10' comprises a glue tab 66 adjacent the top edge 30 as was the case in the blank 10 of the first embodiment depicted in FIG. 1. The top edge 30, right edge 14, bottom edge 32, and left edge 18 define the perimeter of the blank 10'. Within that perimeter are a series of fold lines that are pre-creased or pre-folded, thereby pre-stressing or weakening the blank 10' at specific locations and along specific paths to facilitate the subsequent forming of the blank 10' into one of the various containers that may be formed from this blank. Several embodiments of these containers are described in further detail below.

Figure 16:
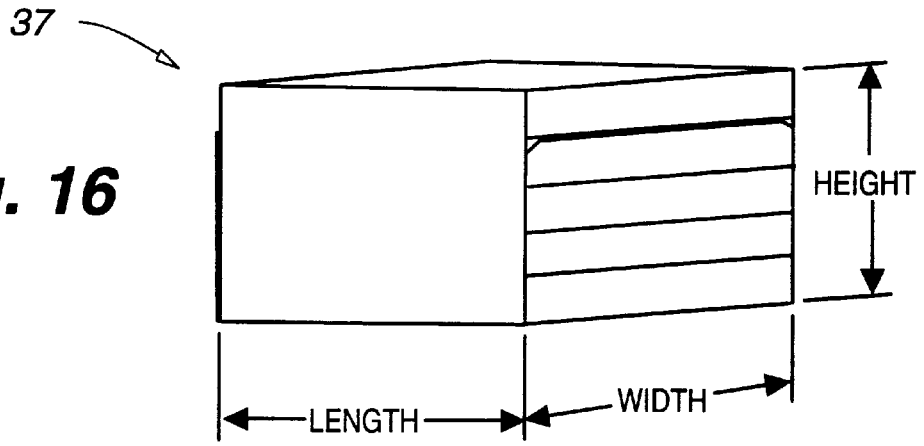
FIGS. 16, 17, 18, 19, 20, 21, 22, 23, 24, 25, and 26 depict eleven possible containers formable from the blank depicted in FIG. 13.

As may readily be seen in FIG. 13, in the second preferred embodiment, the vertical fold lines comprise eight length fold lines 76, 78, 80, 82, 84, 86, 88, 90; and the horizontal fold lines comprise twelve height fold lines 92, 94, 96, 98, 100, 102, 104, 106, 108, 110, 112, 114. Turning briefly to FIG. 16, what the applicants mean by "height" and "length" may be clearly seen. These definitions of "height" and "length" apply to the remainder of the discussion. Returning to FIG. 13, six of the eight length fold lines cross all twelve of the height fold lines, whereas the remaining two of the length fold lines (i.e., the first length fold line 76 and the eighth length fold line 90) are truncated and only cross five height fold lines, namely the second 94, third 96, fourth 98, fifth 100, and sixth 102 height fold lines. The truncated first 76 and eighth 90 length fold lines extend between, but do not cross, the first height fold line 92 and the seventh height fold line 104. A first extended portion is defined by the material bounded by a portion of the left edge 18, a portion of the first height fold line 92, the first length fold line 76, and a portion of the seventh height fold line 104. Similarly, a second extended portion is defined by the material bounded by a portion of the right edge 14, a portion of the first height fold line 92, the eighth length fold line 90, and a portion of the seventh height fold line 104.

As may also be seen in FIG. 13, the twelve height fold lines 92, 94, 96, 98, 100, 102, 104, 106, 108, 110, 112, 114 comprise perforated portions 116 on each of their ends. The perforated portions 116 on the left ends of the height fold lines are labeled in FIG. 13. Corresponding perforated portions exist on the right-hand ends of the height fold lines, but these latter, corresponding perforated portions are not labeled in FIG. 13. These twenty-four perforated portions permit the end flaps of the various containers to be closed. Therefore, once the initial folds are made in forming a container of a desired configuration, at least four tears may be made per end of the container on four different perforated portions to facilitate closure of the end flaps. This process of strategically tearing or separating part of the perforated portions to facilitate closure of the end flaps is described more fully below.

FIG. 14 depicts the blank 10' in FIG. 13 after the glue tab 66 has been attached to the blank 10' near its bottom edge 32, which is done in the preferred embodiments before the blank 10' is folded into a desired configuration. The precursor configuration depicted in FIG. 14 is formed by folding the glue tab 66 back 180° (i.e., into the page in FIG. 13) about the first height fold line 92. Subsequently, the lower half of the blank 10' (i.e., everything below the seventh height fold line 104) is similarly folded back 180° (i.e., into the page in FIG. 13), placing the area of the blank 10' adjacent the bottom edge 32 against the glue tab 66, which now separates the upper portion of the blank 10' from the lower portion of the blank 10' as shown in the left-hand edge of FIG. 15. Therefore, the glue tab 66 depicted in FIG. 14 is actually between two layers of the blank 10'. The glue tab 66 is not shown in phantom in FIG. 14 to avoid confusion between the glue tab 66 and various fold lines. Select components or elements depicted in FIGS. 14 and 15 are labeled for reference, but not all features are labeled.

Figure 17:
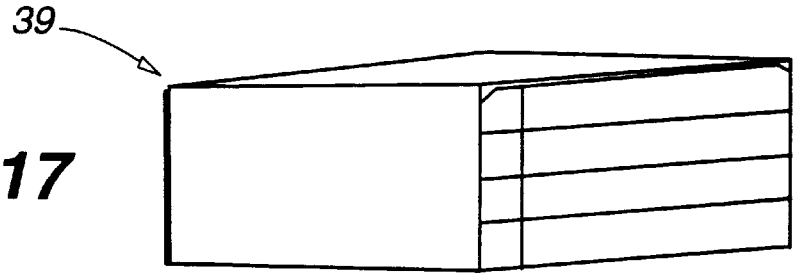
Figure 18:
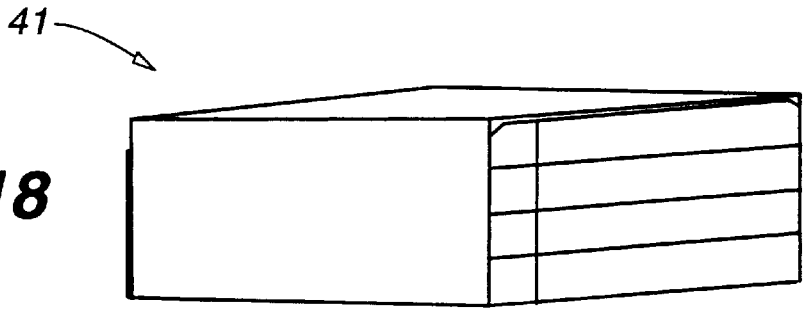
Figure 19:
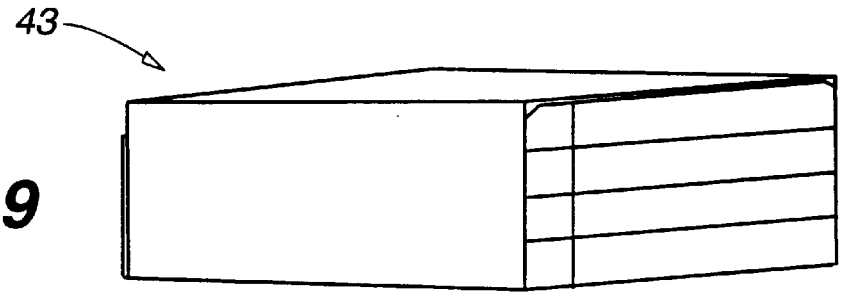
Figure 20:
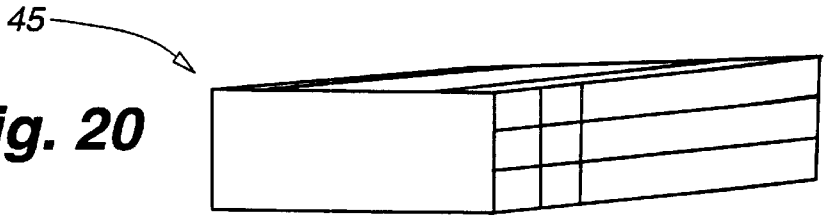
Figure 21:
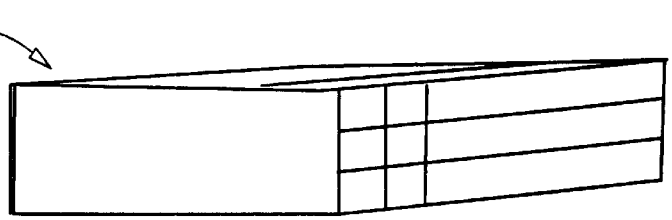
Figure 22:
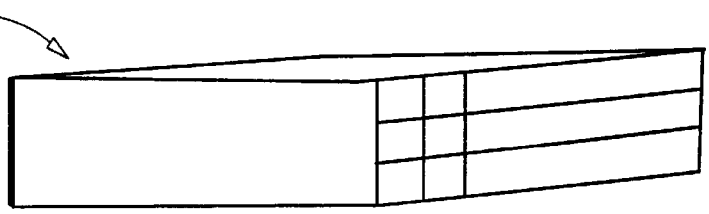
Figure 23:
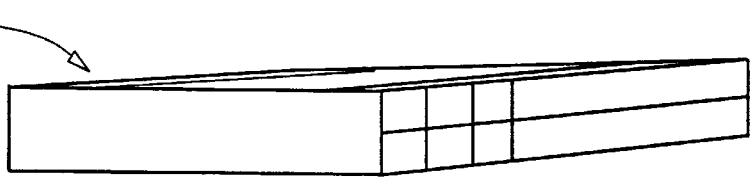
Figure 24:
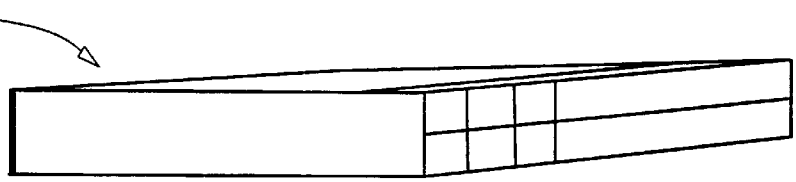
Figure 25:
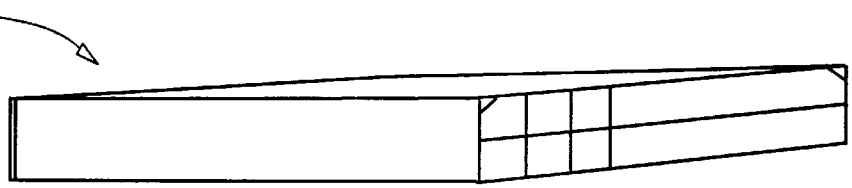
Figure 26:
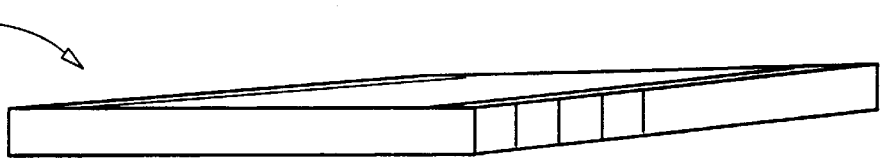

FIGS. 16, 17, 18, 19, 20, 21, 22, 23, 24, 25, and 26 depict eleven possible containers that may be produced by appropriately folding the blank 10' depicted in FIGS. 13, 14, and 15, but additional containers are possible. FIG. 16 depicts a container 37 that is five units high. FIGS. 17, 18, and 19 depict three containers 39, 41, 43, respectively, that are each four units high and the same width, but which have different lengths. FIGS. 20, 21, and 22 depict three containers 45, 47, 49, respectively, that are three units high and the same width, but each of which has a different length. FIGS. 23, 24, and 25 depict three possible containers 53, 55, 57, respectively, that are each two units high and the same width, but which have a different length. FIG. 26 depicts a container 59 that is one unit high.

Figure 27C:
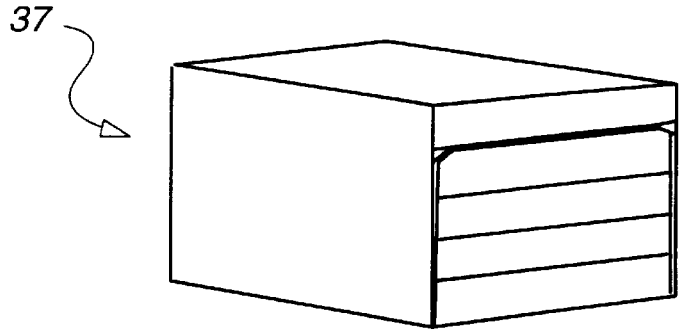
FIG. 27C depicts a possible five-unit high container that may be made from the blank depicted in FIG. 13.
Figure 27B:
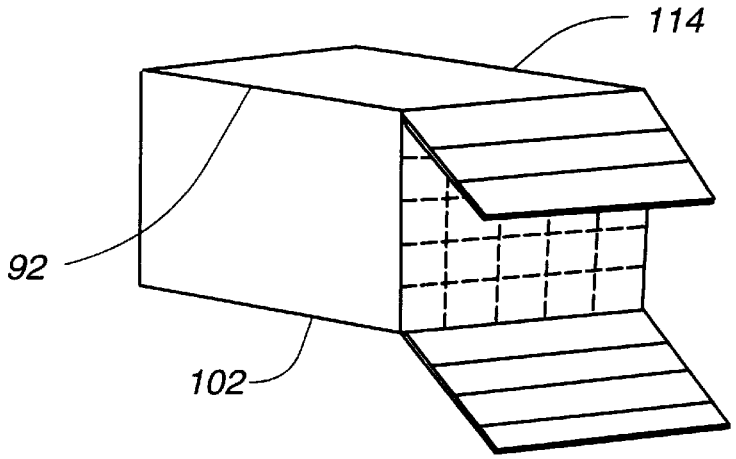
FIGS. 27A and 27B depict two intermediate stages in the process of folding the blank depicted in FIG. 13 into a five-unit high container depicted in FIG. 27C.
Figure 27A:
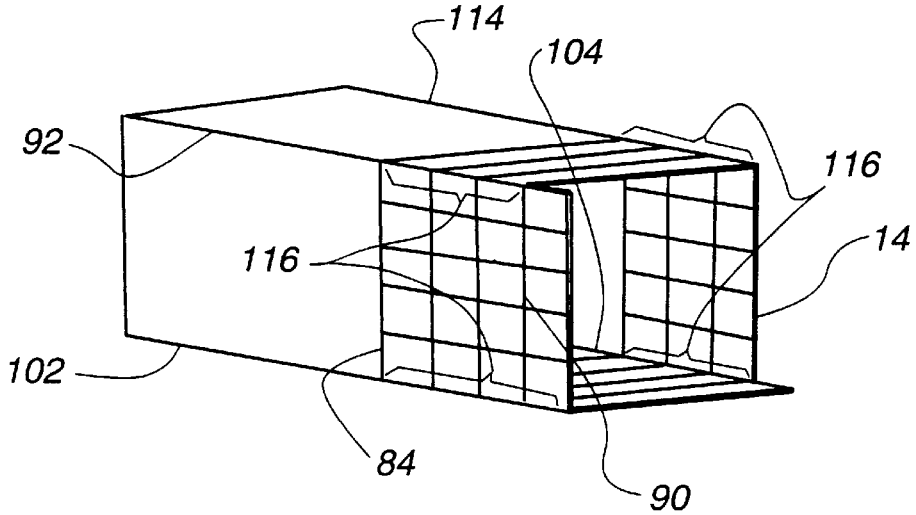

Referring to FIGS. 27A, 27B, and 27C, preferred steps for forming a container (e.g., 37 of FIG. 16) that is five units high are now described. The intermediate stage depicted in FIG. 27A is formed from the precursor form of the blank 10' depicted in FIGS. 14 and 15 by making 90° folds along the first height fold line 92, the sixth height fold line 102, the seventh height fold line 104, and the twelfth height fold line 114. Next, once the desired container length is determined, it is necessary to tear the appropriate amount of the perforated portions 116 on the first 92, sixth 102, seventh 104, and twelfth 114 height fold lines. For example, in the embodiment depicted in FIGS. 27A, 27B, and 27C, a short container is desired. Therefore, commencing at the right edge 14 of the blank 10', the perforated portion 116 of the first height fold line 92 extending between the right edge 14 and the fifth length fold line 84 is separated. Similarly, the perforated portion 116 of the sixth height fold line 102 extending between the fifth length fold line 84 and the right edge 14 of the blank 10' is separated. The perforated portion 116 of the seventh height fold line 104 extending between the right edge 14 and the fifth length fold line 84 is separated. Finally, the perforated portion 116 of the twelfth height fold line 114 between the right edge 14 and the fifth length fold line 84 is also separated. Once these four perforated portions 116 of the appropriate four height fold lines are separated, the end of the container may be closed as depicted in FIGS. 27B and 27C.

Figure 28C:
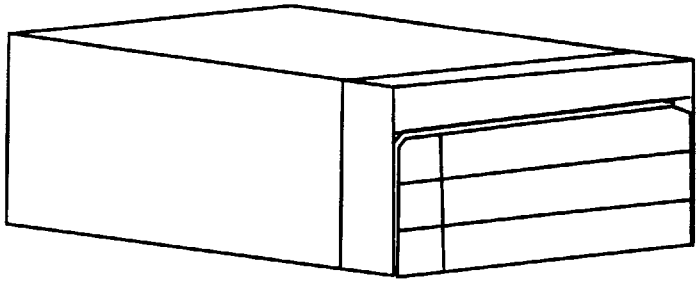
FIG. 28C depicts a possible four-unit high container that may be made from the blank depicted in FIG. 13.
Figure 28B:
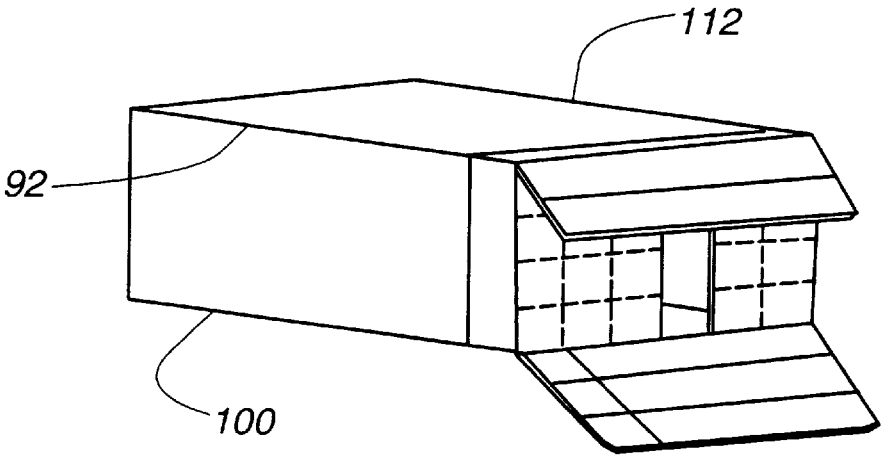
FIGS. 28A and 28B depict two intermediate stages in the process of folding the blank depicted in FIG. 13 into a four-unit high container depicted in FIG. 28C.
Figure 28A:
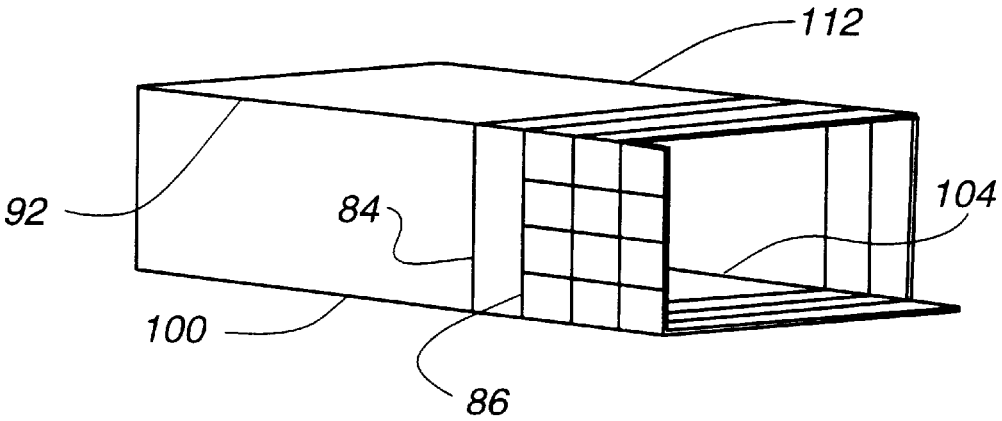

FIGS. 28A, 28B, and 28C depict preferred steps for forming a container (e.g., 39 of FIG. 17, 41 of FIG. 18, or 43 of FIG. 19) that is four units high and six units wide. Looking first to FIG. 28A, the precursor blank 10' depicted in FIGS. 14 and 15 has been folded into the depicted configuration by making 90° bends along the first height fold line 92, the fifth height fold line 100, the seventh height fold line 104, and the eleventh height fold line 112. Then, once the desired length of the resulting container has been determined, appropriate parts of the perforated portions 116 are separated as described above to facilitate closure of the ends of the container. The four resulting end flaps are closed by making appropriate 90° bends along the sixth length fold line 86 after the appropriate parts of the perforated portions 116 have been separated. Completing closure of the four end flaps creates the container depicted in FIG. 28C.

Figure 29C:
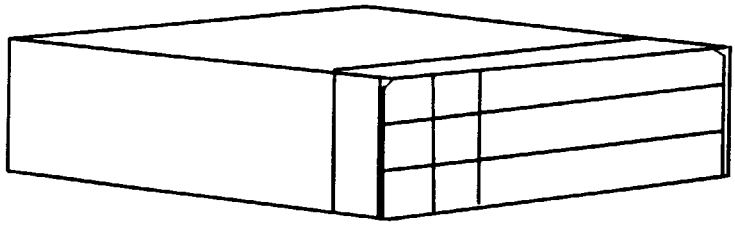
FIG. 29C depicts a possible three-unit high container that may be made from the blank depicted in FIG. 13.
Figure 29B:
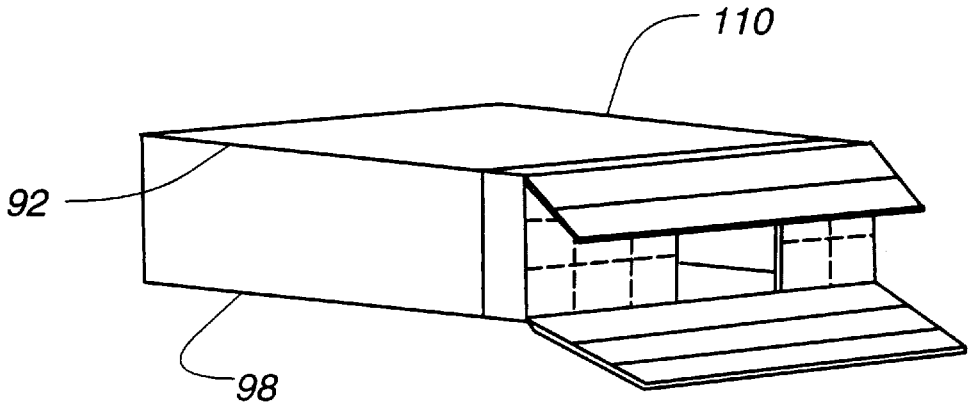
FIGS. 29A and 29B depict two intermediate stages in the process of folding the blank depicted in FIG. 13 into a three-unit high container depicted in FIG. 29C.
Figure 29A:
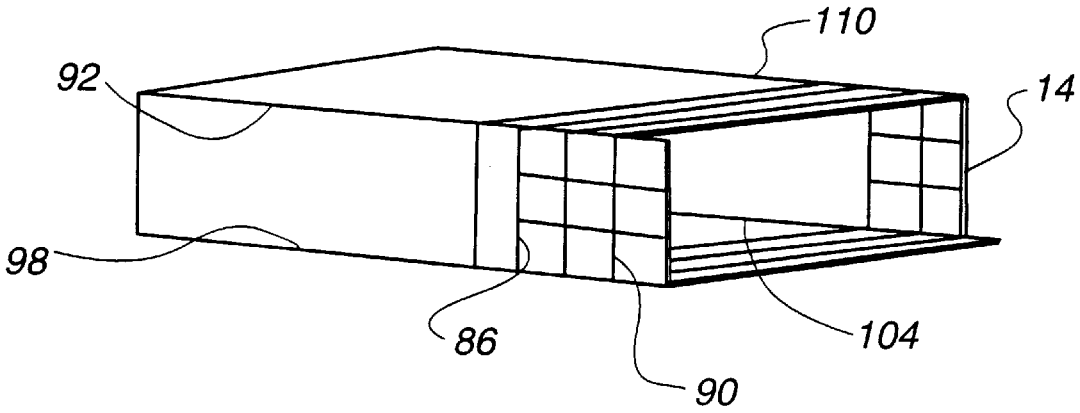

Referring now to FIGS. 29A, 29B, and 29C, preferred steps for forming a container (e.g., 45 of FIG. 20, 47 of FIG. 21, or 49 of FIG. 22) that is three units high are described. Referring in particular to FIG. 29A, this intermediate configuration is obtained by making four 90° bends in the blank 10' depicted in FIGS. 14 and 15. In particular, 90° bends need to be made in the blank 10' depicted in FIG. 14 at the first height fold line 92, the fourth height fold line 98, the seventh height fold line 104, and the tenth height fold line 110. Once these four 90° bends have been made, the intermediate configuration depicted in FIG. 29A is attained. Next, appropriate parts of the perforated portions 116 of these four height fold lines 92, 98, 104, 110 need to be separated to facilitate closure of the four end flaps shown in FIG. 29B. Once the end flaps depicted in FIG. 29B are closed, the container depicted in FIG. 29C is attained.

Figure 30C:
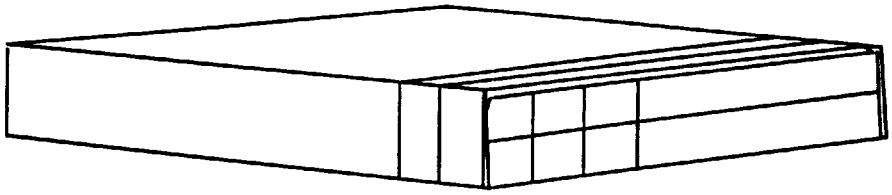
FIG. 30C depicts a possible two-unit high container that may be made from the blank depicted in FIG. 13.
Figure 30B:
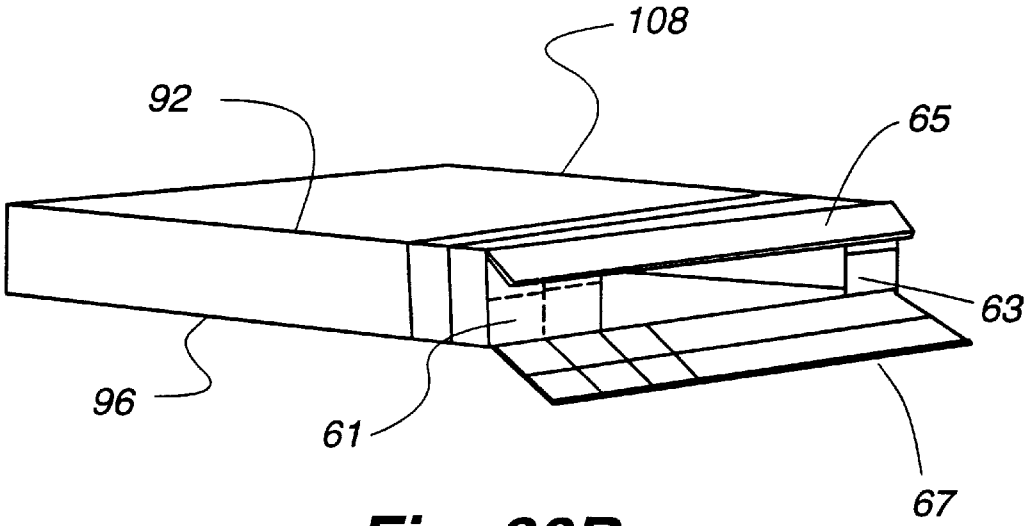
FIGS. 30A and 30B depict two intermediate stages in the process of folding the blank depicted in FIG. 13 into a two-unit high container depicted in FIG. 30C.
Figure 30A:
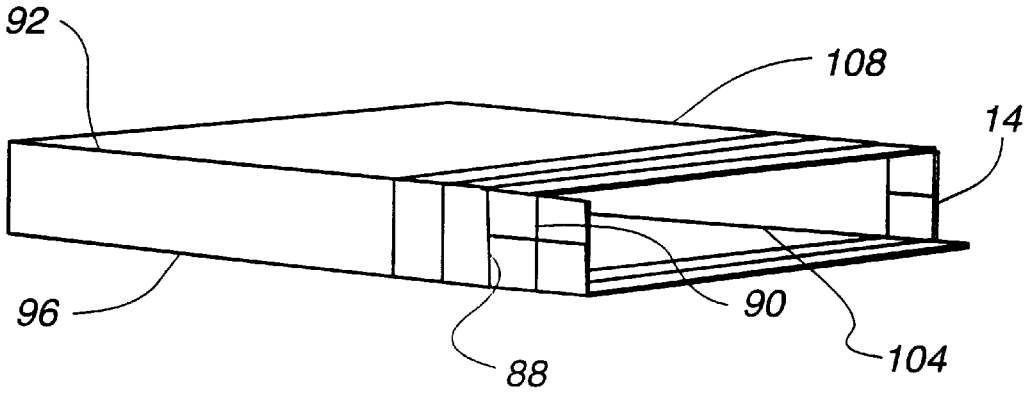

Referring next to FIGS. 30A, 30B, and 30C, preferred steps for forming a two-unit high container (e.g., 53 of FIG. 23, 55 of FIG. 24, or 57 of FIG. 25) from the blank 10' depicted in FIG. 13 are described next. To attain the intermediate configuration depicted in FIG. 30A, four 90° bends are made in the precursor blank 10' depicted in FIGS. 14 and 15. These 90° bends are made at the first height fold line 92, the third height fold line 96, the seventh height fold line 104, and the ninth height fold line 108. In this container, the desired length is attained by making appropriate 90° folds along the seventh length fold line 88. Before these latter 90° folds may be performed, however, appropriate parts of the perforated portions 116 of the first 92, third 96, seventh 104, and ninth 108 height fold lines must be separated. Once these four parts of the appropriate perforated portions 116 are separated, the four flaps depicted in FIG. 30B result. To complete the container depicted in FIG. 30C, the left and right flaps 61, 63, respectively, are closed followed by the top flap 65, and then the bottom flap 67.

Figure 31C:
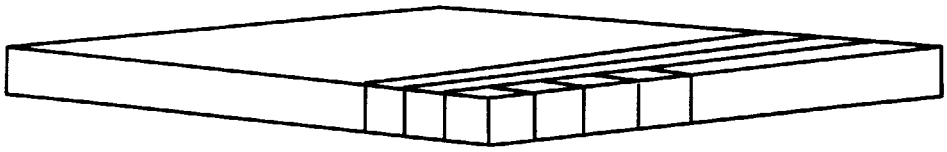
FIG. 31C depicts a possible one-unit high container that may be formed from the blank depicted in FIG. 13.
Figure 31B:
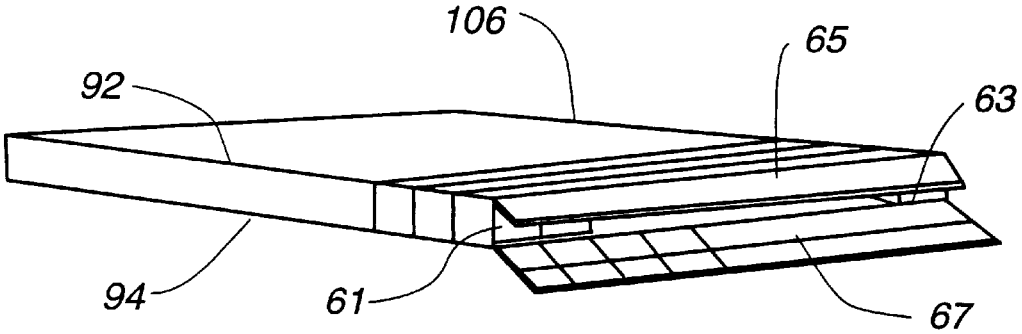
FIGS. 31A and 31B depict two intermediate stages in the process of folding the blank depicted in FIG. 13 into a one-unit high container depicted in FIG. 31C.
Figure 31A:
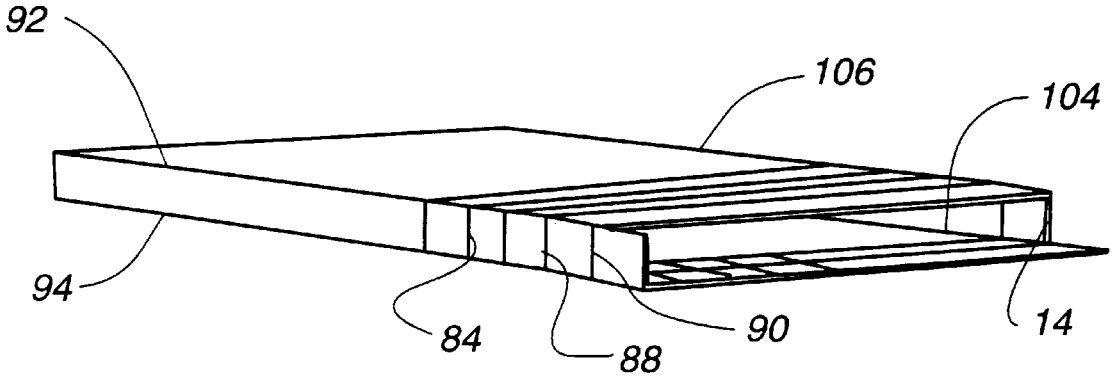

Referring next to FIGS. 31A, 31B, and 31C, preferred steps for forming a one-unit high container (e.g., 59 of FIG. 26) that may be formed using the blank 10' depicted in FIGS. 13, 14, and 15 are described. To attain the intermediate configuration depicted in FIG. 31A, four 90° bends must be made along appropriate height fold lines of the precursor blank 10' depicted in FIGS. 14 and 15. These appropriate fold lines are the first height fold line 92, the second height fold line 94, the seventh height fold line 104, and the eighth height fold line 106. The next step toward completing the container depicted in FIG. 31C comprises separating appropriate parts of the perforated portions 116 along the first 92, second 94, seventh 104, and eighth 106 height fold lines. The appropriate part of the perforated portions 116 comprise the portions along the four named height fold lines from the right edge 14 of the blank 10' to the seventh length fold line 88 in this example. Once these four separations are made, the four flaps 61, 63, 65, 67 visible in FIG. 31B are present. To complete the final container depicted in FIG. 31C, the left and right end flaps 62, 63, respectively, depicted in FIG. 31B are folded toward the inside of the container followed by the top flap 65 and then the bottom flap 67. Since the bottom flap 67 is longer than the height of the container depicted in FIG. 31C, the bottom flap 67 covers the end of the container and extends onto its top surface.

It should be apparent from the blank as depicted in FIGS. 13 and 14 that length adjustments may be made at either end of the container, even though, for purposes of illustration, FIGS. 27A, 27B, 27C, 28A, 28B, 28C, 29A, 29B, 29C, 30A, 30B, 30C, 31A, 31B, and 31C only depict length adjustments being made on one end of the container.

Although a sample of container shapes has been described above and steps have been provided for forming these various containers, it will be apparent to one skilled in the art that different containers may be made from the above-described blanks, and different steps may be followed to fold the blanks into containers. Additionally, for the blank 10' depicted in FIG. 13, additional height fold lines and length fold lines may be present to expand the variety of containers that may be formed from this blank 10'. Further, all directional references (e.g., upper, lower, downward, left, right, bottom, top, below, and counterclockwise) used above are to aid the reader's understanding of the present invention, but should not create limitations, particularly as to the orientation of the blank. It is intended that all matter contained in the above description or shown in the accompanying drawings shall be interpreted as illustrative only and not limiting.

We claim:

1. A blank from which multiple containers may be formed one at a time includes a substantially rectangular sheet of foldable and creasable material, said blank comprising a top edge and a bottom edge, wherein said top edge is parallel to said bottom edge;

a left edge and a right edge, wherein said left edge is parallel to said right edge, and wherein said left edge comprises a lower left edge portion and an upper left edge portion that is parallel to but offset from said lower left edge portion, and wherein said right edge comprises a lower right edge portion and an upper right edge portion that is parallel to but offset from said lower right edge portion;

at least four height fold lines extending parallel to said top and bottom edges, wherein, when forming a container, said blank is adapted to be folded long four height fold lines selected from said at least four height fold lines, and wherein said at least four height fold lines includes a first height fold line adjacent to said top edge and a center height fold line evenly dividing a perpendicular distance between said first height fold line and said bottom edge, wherein a first number of height fold lines exists between said first height fold line and said center height fold line, and a second number of height fold lines exists between said center height fold line and said bottom edge, wherein said first number equals said second number, a bottom portion defining a first area between said center height fold line and said bottom edge, and between said lower left edge portion and said lower right edge portion;

a top portion defining a second area between said center height fold line and said first height fold line, and between said upper left edge portion and said upper right edge portion;

a tab adjacent to said top edge, wherein said tab defines a third area above said first height fold line and below said top edge, said tab being adapted to be secured to the blank adjacent to said bottom edge;

at least two length fold lines extending perpendicularly to said at least four height fold lines, wherein, when forming the container, said blank is adapted to be folded along two length fold lines selected from said at least two length fold lines;

wherein said at least two length fold lines includes a first length fold line and a last length fold line, and wherein said first length fold line is adjacent to said upper left edge portion and colinear with said lower left edge portion, thereby defining a first extended portion defining a fourth area between said first length fold line and said upper left edge portion, and wherein said last length fold line is adjacent to said upper right edge portion and colinear with said lower right edge portion, thereby defining a second extended portion defining a fifth area between said last length fold line and said upper right edge portion, said fourth and fifth areas comprising part of said second area; and wherein each of said at least four height fold lines includes perforated end portion.

2. The blank of claim 1, wherein said blank further comprises a plurality of pre-formed panels.

3. The blank of claim 1, wherein said at least four height fold lines consists of twelve height fold lines and wherein said at least two length fold lines consists of eight length fold lines.

4. The blank of claim 1, wherein said at least four height fold lines comprise twelve height fold lines, wherein said at least two length fold lines comprise eight length fold lines, said last length fold line being an eighth length fold line, and wherein said first and eighth length fold lines are less than one-half as long as said remaining six length fold lines.

5. The blank of claim 4, wherein said blank further comprises twelve pre-formed panels.

6. The blank of claim 5, wherein ten of said twelve pre-formed panels are a first size, and wherein the other two of said twelve pre-formed panels are a second size that is larger than said first size.

* * * * *